US005926788A

United States Patent [19]

Nishiguchi

[11] Patent Number: 5,926,788

[45] Date of Patent: Jul. 20, 1999

[54] METHOD AND APPARATUS FOR REPRODUCING SPEECH SIGNALS AND METHOD FOR TRANSMITTING SAME

[75] Inventor: Masayuki Nishiguchi, Kanagawa, Japan

[73] Assignee: Sony Corporation, Tokyo, Japan

[21] Appl. No.: 08/664,512

[22] Filed: Jun. 17, 1996

[30] Foreign Application Priority Data

Jun. 20, 1995 [JP] Japan ..... 7-153723

[51] Int. Cl.[6] ..... G10L 3/02

[52] U.S. Cl. ..... 704/265; 704/206; 704/211; 704/220; 704/266

[58] Field of Search ..... 395/2.74, 2.16, 395/2.31, 2.32, 2.28, 2.67, 2.77; 704/265, 266, 258, 268, 207, 208, 222, 223, 219, 220, 211, 205, 206, 262, 200, 214

[56] References Cited

U.S. PATENT DOCUMENTS

| | | | |
|---|---|---|---|
| 5,038,097 | 8/1991 | Imanaka | 324/77 B |
| 5,327,520 | 7/1994 | Chen | 395/2.38 |
| 5,371,853 | 12/1994 | Kao et al. | 395/2.32 |
| 5,479,559 | 12/1995 | Fette et al. | 395/2.16 |
| 5,581,656 | 12/1996 | Hardwick et al. | 704/258 |
| 5,602,961 | 2/1997 | Kolesnik et al. | 395/2.32 |
| 5,729,694 | 3/1998 | Holzrichter et al. | 704/207 |

FOREIGN PATENT DOCUMENTS

| | | | |
|---|---|---|---|
| 0154381A2 | 11/1985 | European Pat. Off. | G10L 9/14 |
| WO 9401860 | 1/1994 | WIPO | G10L 9/08 |

*Primary Examiner*—Richemond Dorvil
*Attorney, Agent, or Firm*—Jay H. Maioli

[57] ABSTRACT

An encoding unit 2 divides speech signals provided to an input terminal 10 into frames and encodes the divided signals on the frame basis to output encoding parameters such as line spectral pair (LSP) parameters, pitch, voiced (V)/unvoiced (UV) or spectral amplitude $A_m$. The modified encoding parameter calculating unit 3 interpolates the encoding parameters for calculating modified encoding parameters associated with desired time points. A decoding unit 6 synthesizes sine waves and the noise based upon the modified encoding parameters and outputs the synthesized speech signals at an output terminal 37. Speed control can be achieved easily at an arbitrary rate over a wide range with high sound quality with the phoneme and the pitch remaining unchanged.

12 Claims, 15 Drawing Sheets

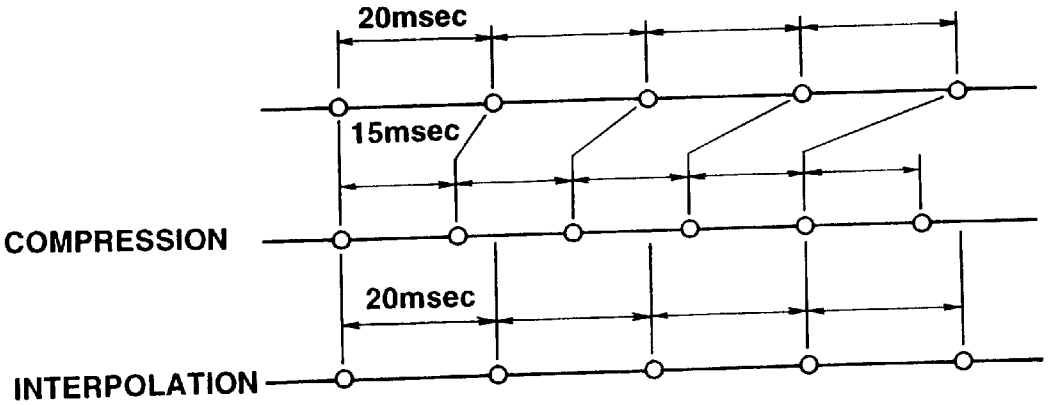
FIG.12A
FIG.12B
FIG.12C
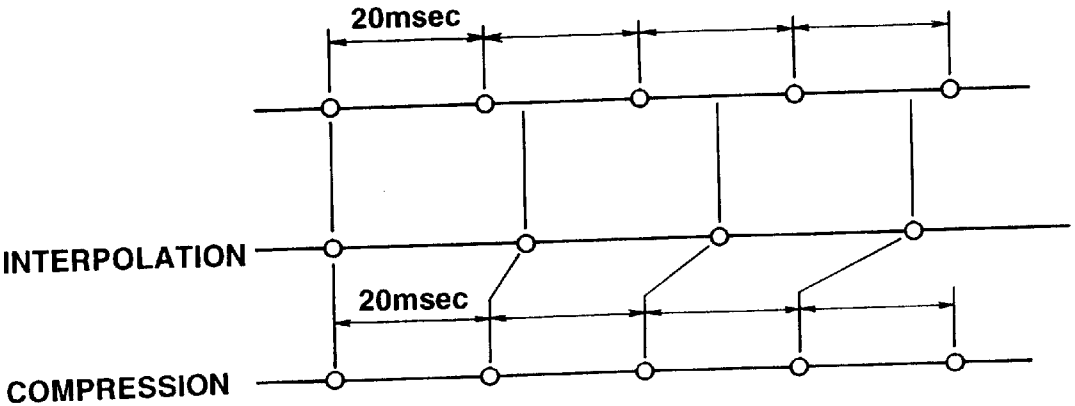
FIG.13A
FIG.13B
FIG.13C

METHOD AND APPARATUS FOR REPRODUCING SPEECH SIGNALS AND METHOD FOR TRANSMITTING SAME

BACKGROUND OF THE INVENTION

1. Field of the Invention

This invention relates to a method and apparatus for reproducing speech signals in which an input speech signal is divided into plural frames as units and encoded to find encoding parameters based on which at least sine waves are synthesized for reproducing the speech signal. The invention also relates to a method for transmitting modified encoding parameters obtained on interpolating the encoding parameters.

2. Description of the Related Art

There are currently known a variety of encoding methods for compressing signals by exploiting statistic properties of the audio signals, inclusive of speech signals and sound signals, in the time domain and in the frequency domain, and psychoacoustic characteristics of the human auditory system. These encoding methods are roughly classified into encoding on the time domain, encoding on the frequency domain and encoding by analysis/synthesis.

Meanwhile, with the high-efficiency speech encoding method by signal processing on the time axis, exemplified by code excited linear prediction (CELP), difficulties are met in speed conversion (modification) of the time axis because of rather voluminous processing operations of signals outputted from a decoder.

In addition, the above method cannot be used for e.g. pitch rate conversion because speed control is carried out in the decoded linear range.

In view of the foregoing, it is an object of the present invention to provide a method and apparatus for reproducing speech signals and a method for transmission of speech signals, in which the speed control of an arbitrary rate over a wide range can be carried out easily with high quality with the phoneme and the pitch remaining unchanged.

In one aspect, the present invention provides a method for reproducing an input speech signal based on encoding parameters obtained by splitting the input speech signal in terms of pre-set frames on the time axis and encoding the thus split input speech signal on the frame basis, comprising the steps of interpolating the encoding parameters for finding modified encoding parameters associated with desired time points and generating a modified speech signal different in rate from said input speech signal based on the modified encoding parameters. Thus the speed control at an arbitrary rate over a wide range can be performed with high signal quality easily with the phoneme and the pitch remaining unchanged.

In another aspect, the present invention provides an apparatus for reproducing a speech signal in which an input speech signal is regenerated based on encoding parameters obtained by splitting the input speech signal in terms of pre-set frames on the time axis and encoding the thus split input speech signal on the frame basis, including interpolation means for interpolating the encoding parameters for finding modified encoding parameters associated with desired time points and speech signal generating means for generating a modified speech signal different in rate from said input speech signal based on the modified encoding parameters. Thus it becomes possible to adjust the transmission bit rate. Thus the speed control at an arbitrary rate over a wide range can be performed with high signal quality easily with the phoneme and the pitch remaining unchanged.

In still another aspect, the present invention provides a method for transmitting speech signals wherein encoding parameters are found by splitting an input speech signal in terms of pre-set frames on the time axis as units and by encoding the this split input speech signal on the frame basis to find encoding parameters, the encoding parameters thus found are interpolated to find modified encoding parameters associated with a desired time point, and the modified encoding parameters are transmitted, thus enabling adjustment of the transmission bit rate.

By dividing the input speech signal in terms of pre-set frames on the time axis and encoding the frame-based signal to find encoding parameters, by interpolating the encoding parameters to find modified encoding parameters, and by synthesizing at least sine waves based upon the modified encoding parameters for reproducing speech signals, speed control becomes possible at an arbitrary rate.

BRIEF DESCRIPTION OF THE DRAWINGS

FIGS. 12A, 12B and 12C are schematic views showing an illustrative operation of the modified encoding parameter calculating circuit.

FIGS. 13A, 13B and 13C are schematic views showing another illustrative operation of the modified encoding parameter calculating circuit.

DESCRIPTION OF THE PREFERRED EMBODIMENTS

Figure 1:
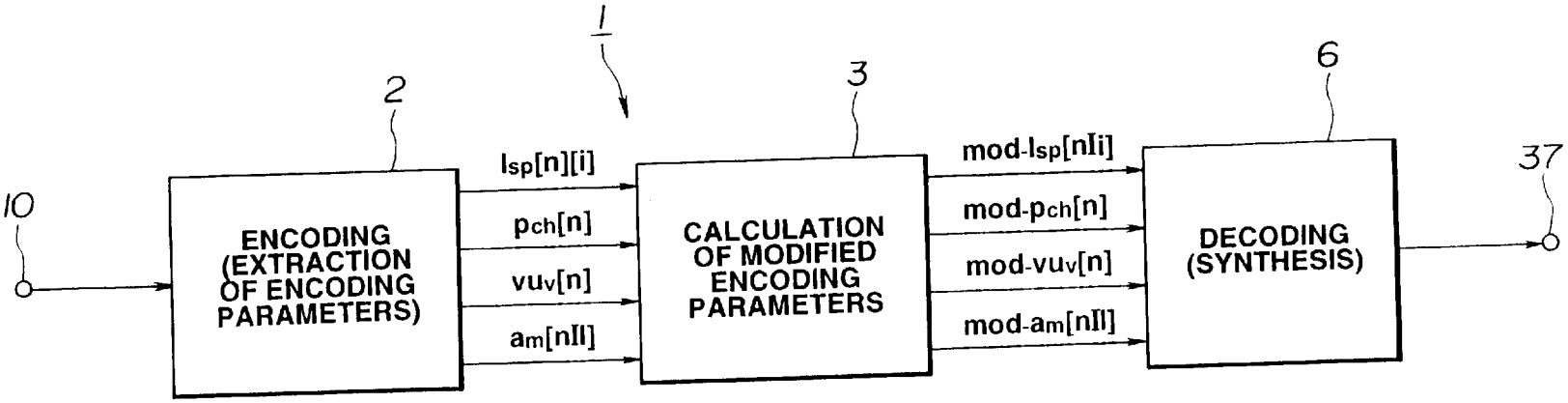
FIG. 1 is a schematic block diagram showing an arrangement of a speech signal reproducing device according to a first embodiment of the present invention.

Referring to the drawings, preferred embodiments of the method and the device for reproducing speech signals and the method for transmitting the speech signals according to the present invention will be explained in detail.

First, a device for reproducing speech signals, in which the method and apparatus for reproducing speech signals according to the present invention are applied, is explained. FIG. 1 shows an arrangement of a speech signal reproducing device 1 in which input speech signals are split in terms of pre-set frames as units on the time axis and encoded on the frame basis to find encoding parameters. Based on these encoding parameters, the sine waves and the noise are synthesized to reproduce speech signals.

In particular, with the present speech signal reproducing device 1, the encoding parameters are interpolated to find modified encoding parameters associated with desired time points, and the sine waves and the noise are synthesized based upon these modified encoding parameters. Although the sine waves and the noise are synthesized based upon the modified encoding parameters, it is also possible to synthesize at least the sine waves.

Specifically, the audio signal reproducing device 1 includes an encoding unit 2 for splitting the speech signals entering an input terminal 10 into frames as units and for encoding the speech signals on the frame basis for outputting encoding parameters such as linear spectra pair (LSP) parameters, pitch, voiced (V)/unvoiced (UV) or spectral amplitudes Am. The audio signal reproducing device 1 also includes a calculating unit 3 for interpolating the encoding parameters for finding modified encoding parameters associated with desired time points, and a decoding unit 6 for synthesizing the sine waves and the noise based on the modified encoding parameters for outputting synthesized speech parameters at an output terminal 37. The encoding unit 2, calculating unit 3 for calculating the modified encoding parameters and the decoding unit 6 are controlled by a controller, not shown.

Figure 2:
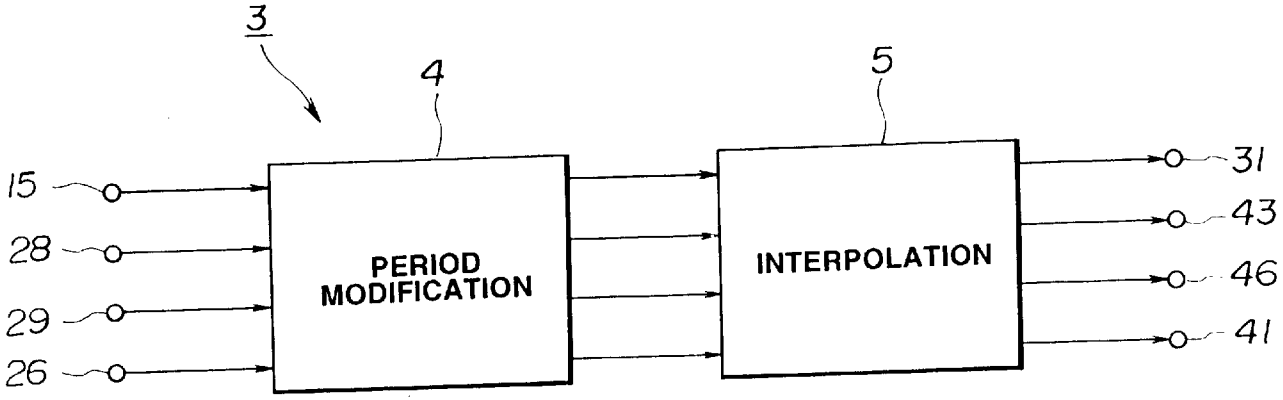
FIG. 2 is a schematic block diagram showing an arrangement of the speech signal reproducing device shown in FIG. 1.

The calculating unit 3 for calculating the modified encoding parameters of the speech signal reproducing device 1 includes a period modification circuit 4 for compressing/expanding the time axis of the encoding parameters, obtained every pre-set frame, for modifying the output period of the encoding parameters, and an interpolation circuit 5 for interpolating the period-modified parameters for producing modified encoding parameters associated with the frame-based time points, as shown for example in FIG. 2. The calculating unit 3 for calculating the modified encoding parameters will be explained subsequently.

First, the encoding unit 2 is explained. The encoding unit 3 and the decoding unit 6 represent the short-term prediction residuals, for example, linear prediction coding (LPC) residuals, in terms of harmonic coding and the noise. Alternatively, the encoding unit 3 and the decoding unit 6 carries out multi-band excitation (MBE) coding or multi-band excitation (MBE) analyses.

With the conventional code excited linear prediction (CELP) coding, the LPC residuals are directly vector-quantized as time waveform. Since the encoding unit 2 encodes the residuals with harmonics coding or MBE analyses, a smoother synthetic waveform can be obtained on vector quantization of the amplitudes of the spectral envelope of the harmonics with a smaller number of bits, while a filter output of the synthesized LPC waveform is also of a highly agreeable sound quality. Meanwhile, the amplitudes of the spectral envelope are quantized using the technique of dimensional conversion or data number conversion proposed by the present inventors in JP Patent Kokai Publication JP-A-6-51800. That is, the amplitudes of the spectral envelope are vector-quantized with a pre-set number of vector dimensions.

Figure 3:
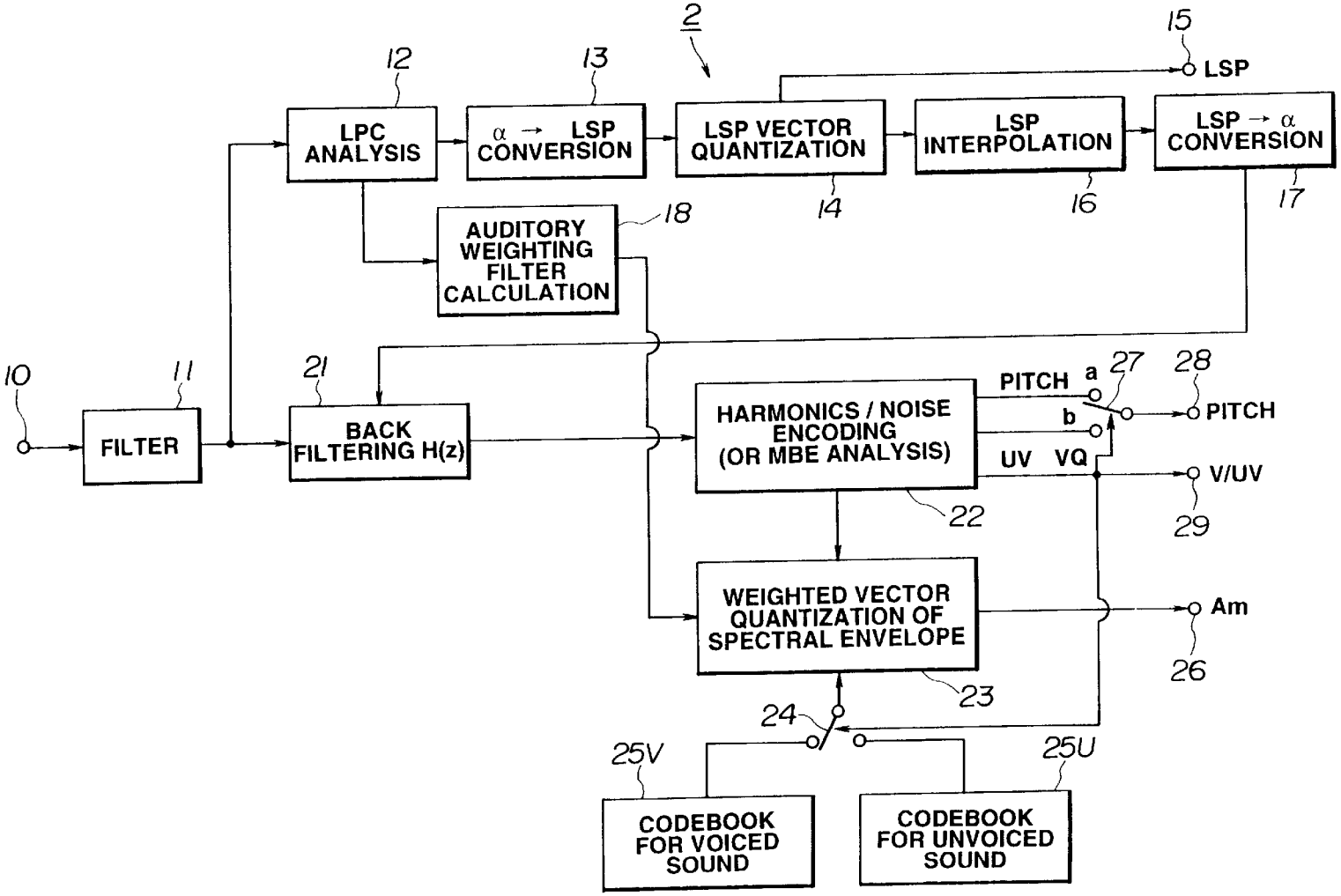
FIG. 3 is a block diagram showing an encoder of the speech signal reproducing device shown in FIG. 1.

FIG. 3 shows an illustrative arrangement of the encoding unit 2. The speech signals supplied to an input terminal 10 are freed of signals of an unneeded frequency range by a filter 11 and subsequently routed to a linear prediction coding (LPC) analysis circuit 12 and a back-filtering circuit 21.

The LPC analysis circuit 12 applies a Hamming window to the input signa waveform, with a length thereof on the order of 256 samples as a block, in order to find linear prediction coefficients, that is so-called α-parameters, by the auto-correlation method. The framing interval as a data outputting unit is on the order of 160 samples. If the sampling frequency fs is e.g., 8 kHz, the framing interval of 160 samples corresponds to 20 msec.

The α-parameter from the LPC analysis circuit 12 is sent to an-α-to LSP conversion circuit 13 so as to be converted into linear spectral pair (LSP) parameters. That is, the α-parameters, found as direct type filter coefficients, are converted into e.g., ten, that is five pairs of, LSP parameters. This conversion is carried out using e.g., the Newton-Raphson method. The reason the α-parameters are converted into the LSP parameters is that the LSP parameters are superior to α-parameters in interpolation characteristics.

The LSP parameters from the α to LSP converting circuit 13 are vector-quantized by a LSP vector quantizer 14. The interframe difference may be found at this time before proceeding to vector quantization. Alternatively, plural frames may be collected and quantized by matrix quantization. For quantization, the LSP parameters, calculated every 20 msecs, are vector-quantized, with 20 msecs being one frame.

The quantized output from the LSP vector quantizer 14, that is indices of the LSP vector quantization, are taken out at a terminal 15. The quantized LSP vectors are routed to a LSP interpolation circuit 16.

The LSP interpolation circuit 16 interpolates the LSP vectors, vector-quantized every 20 msecs, for providing an eight-fold rate. That is, the LSP vectors are configured for being updated every 2.5 msecs. The reason is that, if the residual waveform is processed with analysis/synthesis by the MBE encoding/decoding method, the envelope of the synthesized waveform presents an extremely smooth waveform, so that, if the LPC coefficients are acutely changed every 20 msecs, peculiar sounds tend to be produced. These peculiar sounds may be prohibited from being produced if the LPC coefficients are gradually changed every 2.5 msecs.

For back-filtering the input speech using the LSP vectors at the interval of 2.5 msecs, thus interpolated, the LSP parameters are converted by a LSP-to-α converting circuit 17 into α-parameters which are coefficients of a direct type filter of e.g., ten orders. An output of the LSP-to-α converting circuit 17 is routed to the back-filtering circuit 21 so as to be back-filtered with the α-parameter updated at an interval of 2.5 msecs for producing a smooth output. An output of the back-filtering circuit 21 is routed to a harmonics/noise encoding circuit 22, specifically a multi-band excitation (MBE) analysis circuit.

The harmonics/noise encoding circuit (MBE analysis circuit) 22 analyzes the output of the back-filtering circuit 21 by a method similar to that of the MBE analysis. That is, the harmonics/noise encoding circuit 22 detects the pitch and calculates the amplitude Am of each harmonics. The harmonics/noise encoding circuit 22 also performs voiced (V)/unvoiced (UV) discrimination and converts the number of amplitudes Am of harmonics, which is changed with the pitch, to a constant number by dimensional conversion. For pitch detection, the auto-correlation of the input LPC residuals, as later explained, is employed for pitch detection.

Figure 4:
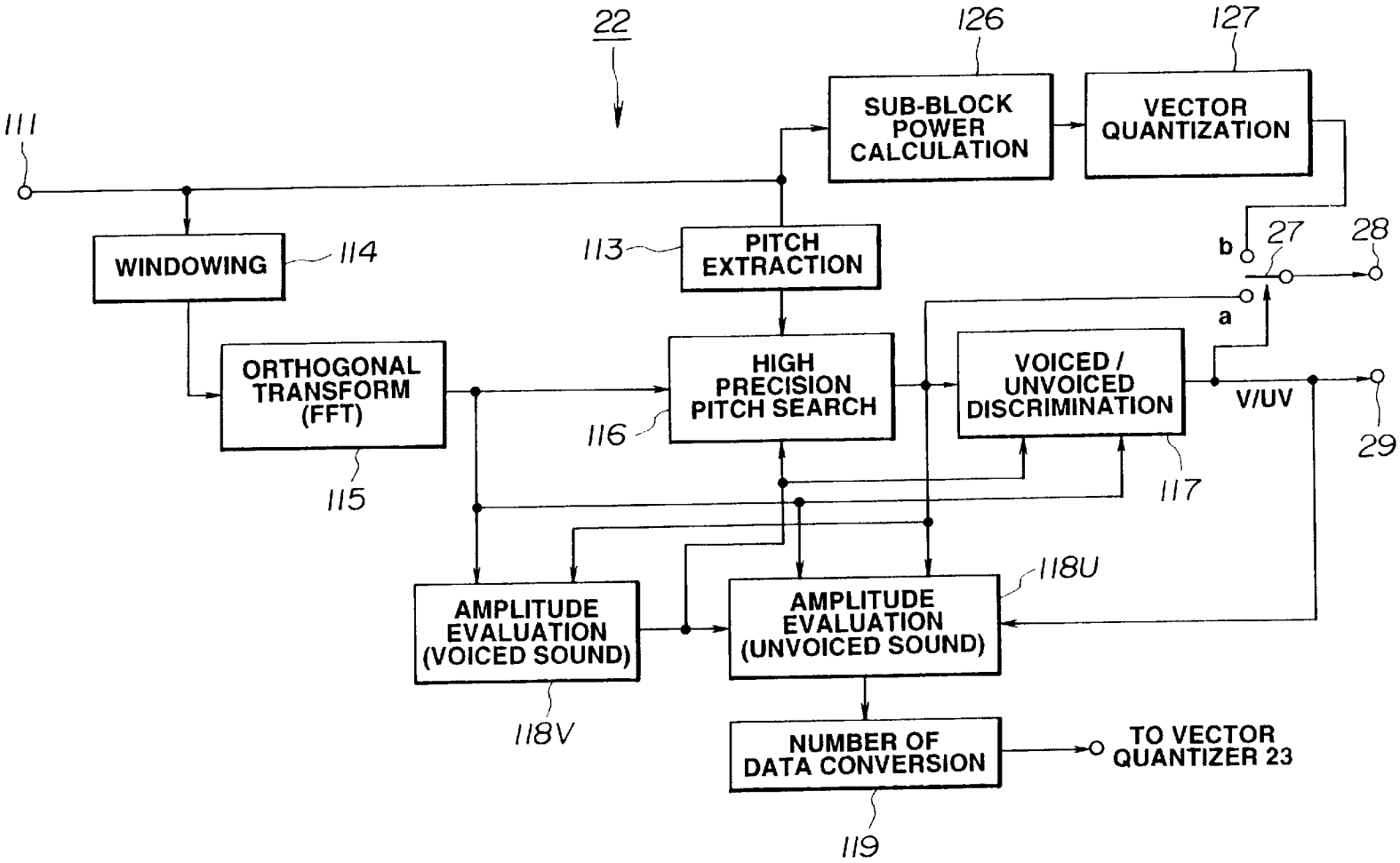
FIG. 4 is a block diagram showing an arrangement of a multi-band excitation (MBE) analysis circuit as an illustrative example of the harmonics/noise encoding circuit of the encoder.

Referring to FIG. 4, an illustrative example of an analysis circuit of multi-band excitation (MBE) coding, as the harmonics/noise encoding circuit 22, is explained in detail.

With the MBE analysis circuit, shown in FIG. 4, modelling is designed on the assumption that there exist a voiced portion and an unvoiced portion in a frequency band of the same time point, that is of the same block or frame.

The LPC residuals or the residuals of the linear predictive coding (LPC) from the back-filtering circuit 21 are fed to an input terminal 111 of FIG. 4. Thus the MBE analysis circuit performs MBE analysis and encoding on the input LPC residuals.

The LPC residual, entering the input terminal 111, is sent to a pitch extraction unit 113, a windowing unit 114 and a sub-block power calculating unit 126 as later explained.

Since the input to the pitch extraction unit 113 is the LPC residuals, pitch detection can be performed by detecting the maximum value of auto-correlation of the residuals. The pitch extraction unit 113 perform pitch search by open-loop search. The extracted pitch data is routed to a fine pitch search unit 116 where a fine pitch search is performed by closed-loop pitch search.

The windowing unit 114 applies a pre-set windowing function, for example, a Hamming window, to each N-sample block, for sequentially moving the windowed block along the time axis at an interval of an L-sample frame. A time-domain data string from the windowing unit 114 is processed by an orthogonal transform unit 115 with e.g., fast Fourier transform (FFT).

If the totality of bands in a block are found to be unvoiced (UV), the sub-block power calculating unit 126 extracts a characteristic quantity representing an envelope of the time waveform of the unvoiced sound signal of the block.

The fine pitch search unit 116 is fed with rough pitch data of integer numbers, extracted by the pitch extraction unit 113, and with frequency-domain data produced by FFT by the orthogonal transform unit 115. The fine pitch search unit 116 effects wobbling by ±several samples at an interval of 0.2 to 0.5 about the rough pitch data value as the center for driving to a fine pitch data with an optimum decimal point (floating). The fine search technique employs analysis by synthesis method and selects the pitch which will give the power spectrum on synthesis which is closest to the power spectrum of the original power spectrum.

That is, a number of pitch values above and below the rough pitch found by the pitch extraction unit 113 as the center are provided at an interval of e.g., 0.25. For these pitch values, which differ minutely from one another, a sum of errors $\Sigma\epsilon_m$ is found. In this case, if the pitch is set, the bandwidth is set, so that, using the power spectrum on the frequency-domain data and the excitation signal spectrum, the error $\epsilon_m$ is found. Thus the error sum $\Sigma\epsilon_m$ for the totality of bands may be found. This error sum $\Sigma\epsilon_m$ is found for every pitch value and the pitch corresponding to the minimum error sum is selected as being an optimum pitch. Thus the optimum fine pitch, with an interval of e.g., 0.25, is found by the fine pitch search unit, and the amplitude $|A_m|$ for the optimum pitch is determined. The amplitude value is calculated by an amplitude evaluation unit 118V for the voiced sound.

In the above explanation of the fine pitch search, the totality of bands are assumed to be voiced. However, since a model used in the MBE analysis/synthesis system is such a model in which an unvoiced region is present on the frequency axis at the same time point, it becomes necessary to effect voiced/unvoiced discrimination from band to band.

The optimum pitch from the fine pitch search unit 116 and data of the amplitude $|A_m|$ from the amplitude evaluation unit for voiced sound 118V are fed to a voiced/unvoiced discriminating unit 117 where discrimination between the voiced sound and the unvoiced sound is carried out from band to band. For this discrimination, a noise to signal ratio (NSR) is employed.

Meanwhile, since the number of bands split based upon the fundamental pitch frequency, that is the number of harmonics, is fluctuated in a range of from about 8 to 63, depending upon the pitch of the sound, the number of V/U flags in each band is similarly fluctuated from band to band. Thus, in the present embodiment, the results of the V/U discrimination are grouped or degraded for each of a pre-set number of bands of fixed bandwidth. Specifically, the pre-set frequency range of e.g., 0 to 4000 Hz, inclusive of the audible range, is split into $N_B$ bands, such as 12 bands, and a weighted mean value of the NSR values of each band is discriminated with a pre-set threshold value $Th_2$ for judging the V/UV from band to band.

The amplitude evaluation unit 118U for unvoiced sound is fed with frequency-domain data from the orthogonal transform unit 115, fine pitch data from the pitch search unit 116, amplitude $|A_m|$ data from the amplitude evaluation unit for voiced sound 118V and with voiced/unvoiced (V/UV) discrimination data from the voiced/unvoiced discriminating unit 117. The amplitude evaluation unit 118U for unvoiced sound again finds the amplitude for a band found to be unvoiced (UV) by voiced/unvoiced discriminating unit 117 by way of effecting amplitude re-evaluation. The amplitude evaluation unit 118U for unvoiced sound directly outputs the input value from the amplitude evaluation unit for voiced sound 118V for a band found to be voiced (V).

The data from the amplitude evaluation unit 118U for unvoiced sound is fed to a data number conversion unit 119, which is a sort of a sampling rate converter. The data number conversion unit 119 is used for rendering the number of data constant in consideration that the number of bands split from the frequency spectrum and the number of data, above all the number of amplitude data, differ with the pitch. That is, if the effective frequency range is up to e.g., 3400 kHz, this effective frequency range is split into 8 to 63 bands, depending on the pitch, so that the number of data $m_{MX}+1$ of the amplitude data $|A_m|$, including the amplitude $|A_m|_{UV}$ of the UV band, is changed in a range of from 8 to 63. Thus the number of data conversion unit 119 converts the amplitude data with the variable number of data of $m_{MX}+1$ into a constant number of data M, such as 44.

The number of data conversion unit 119 appends to the amplitude data corresponding to one effective block on the frequency axis such dummy data which will interpolate values from the last data in a block to the first data in the block for enlarging the number of data to $N_F$. The number of data converting unit 119 then performs bandwidth limiting type oversampling with an oversampling ratio of $O_S$, such as 8, for finding an $O_S$-fold number of amplitude data. This $O_S$-fold number $((m_{MX}+1)\times O_S)$ of the amplitude data is linearly interpolated to produce a still larger number $N_M$ of data, such as 2048 data. The $N_M$ number of data is decimated for conversion to the pre-set constant number M, such as 44 data.

The data (amplitude data with the pre-set constant number M) from the number of data conversion unit 119 is sent to the vector quantizer 23 to provide a vector having the M number of data, or is assembled into a vector having a pre-set number of data, for vector quantization.

The pitch data from the fine pitch search unit 116 is sent via a fixed terminal a of a changeover switch 27 to an output terminal 28. This technique, disclosed in our JP Patent Application No.5-185325 (1993), consists in switching from the information representing a characteristic value representing the time waveform of unvoiced signal to the pitch information if the totality of the bands in the block are unvoiced (UV) and hence the pitch information becomes unnecessary.

These data are obtained by processing data of the N-number of, such as 256, samples. Since the block advances on the time axis in terms of the above-mentioned L-sample frame as a unit, the transmitted data is obtained on the frame basis. That is, the pitch data, V/U discrimination data and the amplitude data are updated on the frame period. As the V/UV discrimination data from the V/UV discrimination unit 117, it is possible to use data the number of bands of which has been reduced or degraded to 12, or to use data specifying one or more position(s) of demarcation between the voiced (V) and unvoiced (UV) region in the entire frequency range. Alternatively, the totality of the bands may be represented by one of V and UV, or V/UV discrimination may be performed on the frame basis.

If a block in its entirety is found to be unvoiced (UV), one block of e.g., 256 samples may be subdivided into plural sub-blocks each consisting e.g., of 32 samples, which are transmitted to the sub-block power calculating unit 126.

The sub-block power calculating unit 126 calculates the proportion or ratio of the mean power or the root mean square value (RMS value) of the totality of samples in a block, such as 256 samples, to the mean power or the root mean square value (RMS value) of each sample in each sub-block.

That is, the mean power of e.g., the k'th sub-block and the mean power of one entire block are found, and the square root of the ratio of the mean power of the entire block to the mean power p(k) of the k'th sub-block is calculated.

The square root value thus found is deemed to be a vector of a pre-set dimension in order to perform vector quantization in a vector quantizer 127 arranged next to the sub-block power calculating unit.

The vector quantizer 127 effects 8-dimensional 8-bit straight vector quantization (codebook size of 256). An output index UV-E for this vector quantization, that is the code of a representative vector, is sent to a fixed terminal b of the changeover switch 27. The fixed terminal a of the changeover switch 27 is fed with pitch data from the fine pitch search unit 116, while an output of the changeover switch 27 is fed to the output terminal 28.

The changeover switch 27 has its switching controlled by a discrimination output signal from the voiced/unvoiced discrimination unit 117, such that a movable contact of the switch 27 is set to the fixed terminals a and b when at least one of the bands in the block is found to be voiced (V) and when the totality of the bands are found to be voiced, respectively.

Thus the vector quantization outputs of the sub-block-based normalized RMS values are transmitted by being inserted into a slot inherently used for transmitting the pitch information. That is, if the totality of the bands in the block are found to be unvoiced (UV), the pitch information is unnecessary, so that, if and only if the V/UV discrimination flags from the V/UV discrimination unit 117 are found to be UV in their entirety, the vector quantization output index UV_E is transmitted in place of the pitch information.

Reverting to FIG. 3, weighted vector quantization of the spectral envelope (Am) in the vector quantizer 23 is explained.

The vector quantizer 23 is of a 2-stage L-dimensional, such as 44-dimensional configuration.

Figure 5:
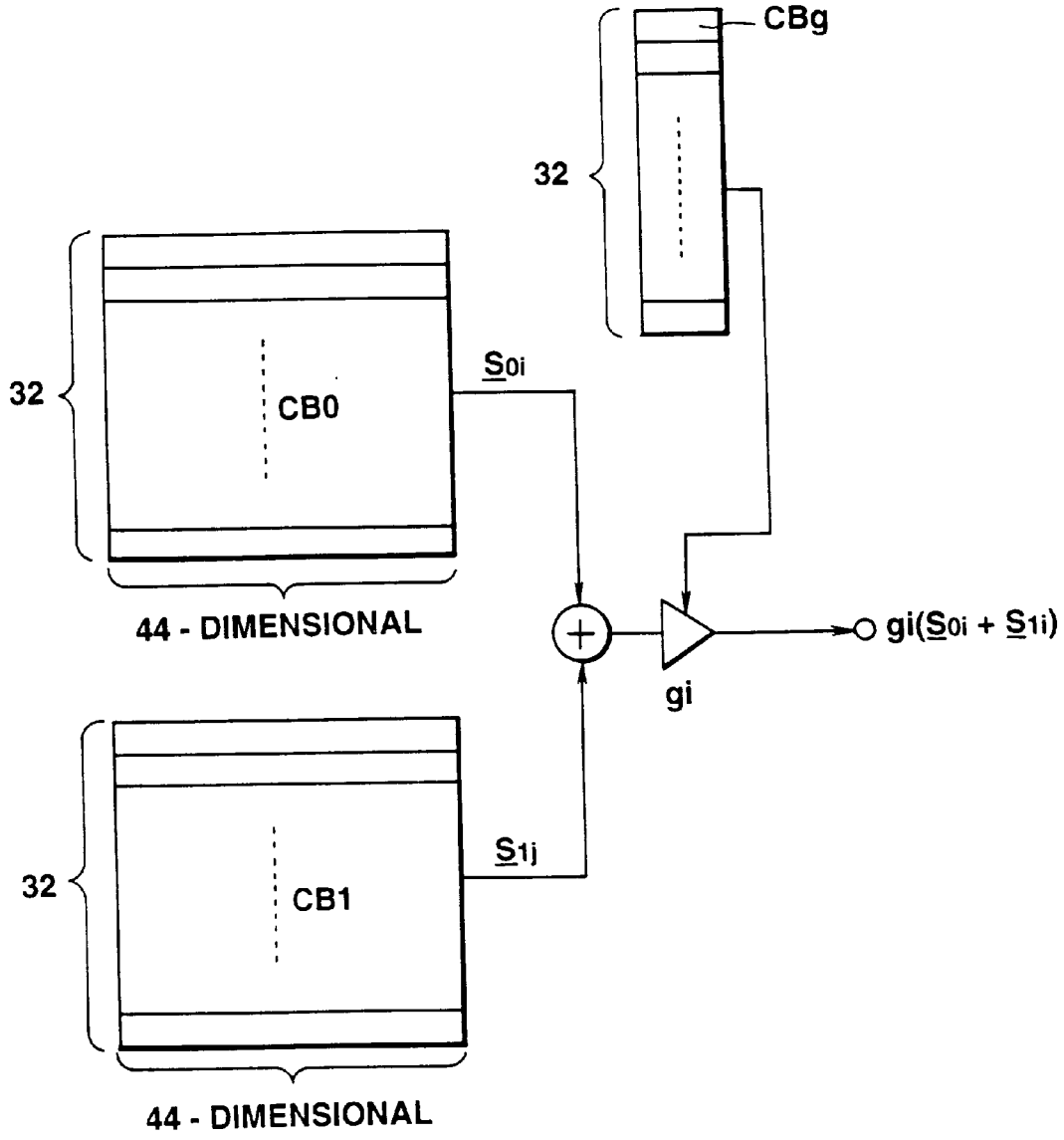
FIG. 5 illustrates an arrangement of a vector quantizer.

That is, the sum of output vectors from the vector quantization codebook, which is 44-dimensional and has a codebook size of 32, is multiplied by a gain $g_i$, and the resulting product is employed as a quantized value of the 44-dimensional spectral envelope vector x. Referring to FIG. 5, CB0, CB1 denote two shape codebooks, output vectors of which are $s_{0i}$ and $s_{1j}$, respectively, where $0 \leqq i$ and $j \leqq 31$. An output of the gain codebook CBg is $g_1$, which is scalar value, where $0 \leqq 1 \leqq 31$. The ultimate output becomes $g_i(s_{0i}+s_{1j})$.

The spectral envelope Am, obtained on MBE analyses of the LPC residuals, and converted to a pre-set dimension, is set to x. It is crucial how to efficiently quantize x.

A quantization error energy E is defined as $$E=\|W\{Hx-Hg_1(s_{0i}+s_{1j})\}\|^2$$
$$=\|WH\{x-g_1(s_{0i}+s_{1j})\}\|^2 \quad (1)$$

where H and W respectively stand for characteristics on the frequency axis of the LPC synthesizing filter and a matrix for weighting representing characteristics of the auditory sense weighting on the frequency axis.

The quantization error energy is found by sampling corresponding L-dimensional, such as 44-dimensional, points from the frequency characteristics of $$H(z) = \frac{1}{1+\sum_{i=1}^{P} \alpha_i z^{-i}}$$

where $\alpha_1$, with $1 \leqq i \leqq P$, denotes $\alpha$-parameters obtained by analyzing the LPC of the current frame.

For calculation, 0s are stuffed next to 1, $\alpha_1, \alpha_2, \ldots, \alpha_p$, to give 1, $\alpha_1, \alpha_2, \ldots, \alpha_p$, 0, 0, . . . , 0 to provide e.g., 256-point data. Then, 256-point FFT is executed and the values of $(r_e^2+I_m^2)^{1/2}$ are calculated for points corresponding to 0~$\pi$. Next, the reciprocals of the calculated values of $(r_e^2+I_m^2)^{1/2}$ are found and decimated to e.g., 44 points. A matrix whose diagonal elements correspond to these reciprocals is given as $$H = \begin{bmatrix} h(1) & & & 0 \\ & h(2) & & \\ & & \ddots & \\ 0 & & & h(L) \end{bmatrix}$$

The auditory sense weighting matrix W is given as $$W(z) = \frac{1 + \sum_{i}^{P} \alpha_i \lambda_b^i z^{-i}}{i + \sum_{i}^{P} \alpha_i \lambda_a^i z^{-i}} \tag{3}$$

where $\alpha_i$ is the result of LPC analysis of an input and $\lambda a$, $\lambda b$ are constants, such that, by way of examples, $\lambda a=0.4$ and $\lambda b=0.9$.

The matrix W may be found from the frequency characteristics of the equation (3). By way of an example, $1, \alpha_1\lambda b, \alpha_2\lambda b^2, \ldots, \alpha_p b^P, 0, 0, \ldots, 0$ are provided to give 256-point data for which FFT is executed to find $(r_e^2[i]+I_m^2[i])^{1/2}$, where $0 \leqq i \leqq 128$. Then, $1, \alpha_1\lambda a, \alpha_2\lambda a^2, \alpha_p a^P, \ldots, 0, 0, \ldots, 0$ are provided and the frequency characteristics of the denominator are calculated with 256-point FFT at 128 points for the domain of 0~π. The resulting values are $(r_{e'}^2[i]+I_{m'}^2[i])^{1/2}$, $0 \leqq i \leqq 128$.

The frequency characteristics of the above equation (3) may be found by $$wo[i] = \frac{\sqrt{re^2[i] + Im^2[i]}}{\sqrt{re'^2[i] + Im'^2[i]}}$$

where $0 \leqq i \leqq 128$.

The frequency characteristics are found by the following method for corresponding points of e.g. 44-dimensional vector. Although linear interpolation needs to be used for more accurate results, the values of the closest points are used in substitution in the following example.

That is, $$\omega[i]=\omega_0[\mathrm{nint}(128i/L)]$$

where $1 \leqq i \leqq L$ and nint(x) is a function which returns an integer closest to x.

As for H, h(1), h(2), . . . , h(L) are found by the similar method. That is, $$H = \begin{bmatrix} h(1) & & & 0 \\ & h(2) & & \\ & & \ddots & \\ 0 & & & h(L) \end{bmatrix} \quad W = \begin{bmatrix} w(1) & & & 0 \\ & w(2) & & \\ & & \ddots & \\ 0 & & & w(L) \end{bmatrix}$$

so that $$WH = \begin{bmatrix} h(1)w(1) & & & 0 \\ & h(2)w(2) & & \\ & & \ddots & \\ 0 & & & h(L)w(L) \end{bmatrix} \tag{4}$$

As a modified embodiment, the frequency characteristics may be found after first finding H(z)W(z) for decreasing the number of times of FFT operations.

That is, $$H(z)W(z) = \frac{1}{1 + \sum_{i=1}^{P} \alpha_i z^{-i}} \cdot \frac{1 + \sum_{i=1}^{P} \alpha_i \lambda_b^i z^{-i}}{1 + \sum_{i=1}^{P} \alpha_i \lambda_a^i z^{-i}} \tag{5}$$

The denominator of the equation (5) is expanded to $$\left(1 + \sum_{i=1}^{P} \alpha_i z^{-i}\right)\left(1 + \sum_{i=1}^{P} \alpha_i \lambda_a^i z^{-i}\right) = 1 + \sum_{i=1}^{2P} \beta_i z^{-i}$$

By setting $1, \beta_1, \beta_2, \ldots, b_{2p}, 0, 0, \ldots, 0$, 256-point data, for example, are formed. 256-point FFT is then executed to provide frequency characteristics of the amplitude such that $$\mathrm{rms}[i] = \sqrt{re''^2[i] + Im''^2[i]}$$

where $0 \leqq i \leqq 128$.

From this, the following equation:

$$wh_0[i] = \frac{\sqrt{re^2[i] + Im^2[i]}}{\sqrt{re''^2[i] + Im''^2[i]}}$$

holds, where $0 \leqq i \leqq 128$.

This is found for each of corresponding points of the L-dimensional vector. If the number of points of the FFT is small, linear interpolation should be used. However, the closest values are herein used. That is, where $1 \leqq i \leqq L$.

$$wh[i] = wh_0\left[n\,\mathrm{int}\left(\frac{128}{L} \cdot i\right)\right] \quad 1 \leq i \leq L$$

A matrix W' having these closest values as diagonal elements is given as $$W' = \begin{bmatrix} wh(1) & & & 0 \\ & wh(2) & & \\ & & \ddots & \\ 0 & & & wh(L) \end{bmatrix} \tag{6}$$

The above equation (6) is the same matrix as the equation (4).

Using this matrix, that is the frequency characteristics of the weighted synthesis filter, the equation (1) is rewritten to $$E=\|W'(x-g_i(s_{ai}+s_{1j}))\|^2 \tag{7}$$

The method of learning the shape codebook and the gain codebook is explained.

First, for all frames which select the code vector $s_{0c}$ concerning CBO, the expected value of the distortion is minimized. If there are M such frames, it suffices to minimize $$J = \frac{1}{M}\sum_{k=1}^{M} \|W'_k(\underline{x}_k - g_k(\underline{s}_{oc} + \underline{s}_{1k}))\|^2 \tag{8}$$

In this equation (8), $W'_k$, $x_k$, $g_k$ and $s_{ik}$ denote the weight to the k'th frame, an input to the k'th frame, the gain of the k'th frame and an output of the codebook CB1 for the k'th frame, respectively.

For minimizing the equation (8), $$\begin{aligned} J &= \frac{1}{M}\sum_{k=1}^{M} \{(\underline{x}_k^T - g_k(\underline{s}_{oc}^T + \underline{s}_{1k}^T))W'^T_k W'_k(\underline{x}_k - g_k(\underline{s}_{oc} + \underline{s}_{1k}))\} \\ &= \frac{1}{M}\sum_{k=1}^{M} \{\underline{x}_k^T W'^T_k W'_k \underline{x}_k - 2g_k(\underline{s}_{oc}^T + \underline{s}_{1k}^T)W'^T_k W'_k \underline{x}_k + \\ &\quad g_k^2(\underline{s}_{oc}^T + \underline{s}_{1k}^T)W'^T_k W_k(\underline{s}_{oc} + \underline{s}_{1k})\} \\ &= \frac{1}{M}\sum_{k=1}^{M} \{\underline{x}_k^T W'^T_k W'_k \underline{x}_k - 2g_k(\underline{s}_{oc}^T + \underline{s}_{1k}^T)W'^T_k W'_k \underline{x}_k + \\ &\quad g_k^2 \underline{s}_{oc}^T W'^T_k W_k \underline{s}_{oc} + 2g_k^2 \underline{s}_{oc}^T W'^T_k W'_k \underline{s}_{1k} + \\ &\quad g_k^2 \underline{s}_{1k}^T W'^T_k W'_k \underline{s}_{1k}\} \end{aligned} \tag{9}$$

$$\frac{\partial J}{\partial \underline{s}_{oc}} = \frac{1}{M}\sum_{k=1}^{M} \{-2g_k W'^T_k W'_k \underline{x}_k + 2g_k^2 W'^T_k W_k \underline{s}_{oc} + 2g_k^2 W'^T_k W_k \underline{s}_{1k}\} = 0 \tag{10}$$

so $$\sum_{k=1}^{M} (g_k W'^T_k W'_k \underline{x}_k - g_k^2 W'^T_k W_k \underline{s}_{1k}) = \sum_{k=1}^{M} g_k^2 W'^T_k W_k \underline{s}_{oc}$$

and hence $$\underline{s}_{oc} = \left\{\sum_{k=1}^{M} g_k^2 W'^T_k W_k\right\}^{-1} \cdot \left\{\sum_{k=1}^{M} g_k W'^T_k W_k(\underline{x}_k - g_k \underline{s}_{1k})\right\} \tag{11}$$

where $\{\ \}^{-1}$ denotes an inverse matrix and $W_k'^T$ denotes a transposed matrix of $W'_k$.

Next, optimization as to the gain is considered.

The expected value $J_g$ of the distortion for the k'th frame selecting the code word $g_c$ of the gain is given by Solving an equation $$J_g = \frac{1}{M}\sum_{k=1}^{M} \|W'_k(\underline{x}_k - g_c(\underline{s}_{oc} + \underline{s}_{1k}))\|^2$$

we obtain $$\begin{aligned} &= \frac{1}{M}\sum_{k=1}^{M} \{\underline{x}_k^T W'^T_k W'_k \underline{x}_k - 2g_c \underline{x}_k^T W'^T_k W'_k(\underline{s}_{ok} + \underline{s}_{1k}) + \\ &\quad g_c^2(\underline{s}_{ok}^T + \underline{s}_{1k}^T)W'^T_k W'_k(\underline{s}_{ok} + \underline{s}_{1k})\} \end{aligned} \tag{12}$$

$$\frac{\partial J_g}{\partial g_c} = \frac{1}{M}\sum_{k=1}^{M} \{-2\underline{x}_k^T W'^T_k W'_k(\underline{s}_{ok} + \underline{s}_{1k}) + 2g_c(\underline{s}_{ok}^T + \underline{s}_{1k}^T)W'^T_k W'_k(\underline{s}_{ok} + \underline{s}_{1k}) = 0$$

$$\sum_{k=1}^{M} \underline{x}_k^T W'^T_k W'_k(\underline{s}_{ok} + \underline{s}_{1k}) = \sum_{k=1}^{M} g_c(\underline{s}_{ok}^T + \underline{s}_{1k}^T)W'^T_k W'_k(\underline{s}_{ok} + \underline{s}_{1k})$$

-continued $$g_c = \frac{\sum_{k=1}^{M} \underline{x}_k^T W'^T_k W'_k(\underline{s}_{ok} + \underline{s}_{1k})}{\sum_{k=1}^{M} (\underline{s}_{ok}^T + \underline{s}_{1k}^T)W'^T_k W'_k(\underline{s}_{ok} + \underline{s}_{1k})}$$

The above equations give an optimum centroid condition for the shape $s_{0i}$, $s_{1i}$ and the gain $g_i$, where $0 \leqq i \leqq 31$, that is an optimum decoding output. The optimum decoding output may similarly be found for $s_{1i}$ as in the case for $s_{0i}$.

Next, the optimum encoding condition (nearest neighbor condition) is considered.

The shape $s_{0i}$, $s_{1i}$ which minimize the equation (7) for the measure of the distortion, that is $E=\|W'(x-g_1(s_{0i}+s_{1j}))\|^2$, are determined each time an input x and the weight matrix W' are given, that is for each frame.

Inherently, E is to be found for all combinations of $g_l$ ($0 \leqq l \leqq 31$), $s_{0i}$ ($0 \leqq i \leqq 31$) and $s_{1j}$ ($0 \leqq j \leqq 31$) that is 32×32×32 combinations, in a round robin fashion, in order to find a set of $g_l$, $s_{0i}$, $s_{ij}$ which will give the least value of E. However, since this leads to a voluminous amount of the arithmetic operations, the encoding unit 2 performs a sequential search for the shape and the gain. The round robin search should be executed for 32×32=1024 combination of $s_{0i}$, $s_{1i}$. In the following explanation, $s_{0i}+s_{1i}$ is written as $s_m$ for simplicity.

The above equation may be written to $E=\|W'(x-g_1 s_m)\|^2$. For further simplification, by setting $x_w=W'x$ and $s_w=W's_m$, we obtain $$E = \|\underline{x}_w - g_1 \underline{s}_w\|^2 \tag{13}$$

$$E = \|\underline{x}_w\|^2 + \|\underline{s}_w\|^2\left(g_1 - \underline{x}_w^T \cdot \frac{\underline{s}_w}{\|\underline{s}_w\|^2}\right)^2 - \frac{(\underline{x}_w^T \cdot \underline{s}_w)^2}{\|\underline{s}_w\|^2} \tag{14}$$

Thus, assuming that sufficient precision for $g_l$ is assured, search can be carried out in two steps of (1) search $s_w$ which maximizes $$\frac{(\underline{x}^T{}_w \cdot \underline{s}_w)^2}{\|\underline{s}_w\|^2}$$

and (2) search $g_l$ which is closest to $$\frac{\underline{x}^T{}_w \cdot \underline{s}_w}{\|\underline{s}_w\|^2}$$

If the above equations are rewritten using the original representation, search can be carried out in two steps of (1)' search for a set of $s_{0i}$, $s_{1j}$ which maximizes $$\frac{\underline{x}^T W'^T W'(\underline{s}_{oi} + \underline{s}_{1j})}{\|W'(\underline{s}_{oi} + \underline{s}_{1j})\|^2} \tag{15}$$

and (2)' search for $g_i$ closest to $$\frac{\underline{x}^T W'^T W'(\underline{s}_{oi} + \underline{s}_{1j})}{\|W'(\underline{s}_{oi} + \underline{s}_{1j})\|^2}$$

The equation (15) gives the optimum encoding condition (nearest neighbor condition).

Using the centroid condition of the equations (11) and (12), and the condition of the equation (15), the codebooks CB0, CB1 and CBg may be trained simultaneously by the generalized Lloyd algorithm (GLA).

Referring to FIG. 3, the vector quantizer 23 is connected via changeover switch 24 to the codebook for voiced sound 25V and to the codebook for unvoiced sound 25U. By controlling the switching of the changeover switch 24 in dependence upon the V/UV discrimination output from the harmonics noise encoding circuit 22, vector quantization is carried out for the voiced sound and for the unvoiced sound using the codebook for voiced sound 25V and the codebook for unvoiced sound 25U, respectively.

The reason the codebooks are switched in dependence upon a judgment as to the voiced sound (V)/unvoiced sound (UV) is that, since weighted averaging of $W'_k$ and $g_1$ is carried out in calculating new centroids according to the equations (11), (12), it is not desirable to average $W'_k$ and $g_1$ which are significantly different in values.

Meanwhile, the encoding unit 2 employs W' divided by the norm of the input x. That is, W'/||x|| is substituted for W' in advance in the processing of the equations (11), (12) and (15).

When switching between the two codebooks in dependence upon V/UV discrimination, training data is distributed in a similar manner for preparing the codebook for the voiced sound and the codebook for the unvoiced sound from the respective training data.

For decreasing the number of bits of V/UV, the encoding unit 2 employs single-band excitation (SBE) and deems a given frame to be a voiced (V) frame and an unvoiced (UV) frame if the ratio of V exceeds 50% and otherwise, respectively.

Figure 6:
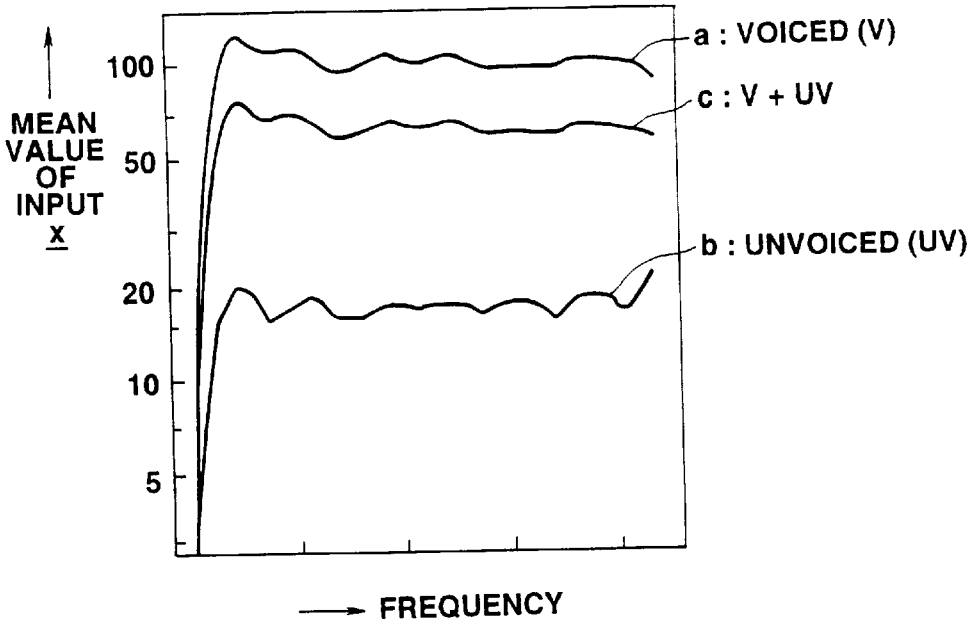
FIG. 6 is a graph showing mean values of an input x for voiced sound, unvoiced sound and for the voiced and unvoiced sound collected together.
Figure 7:
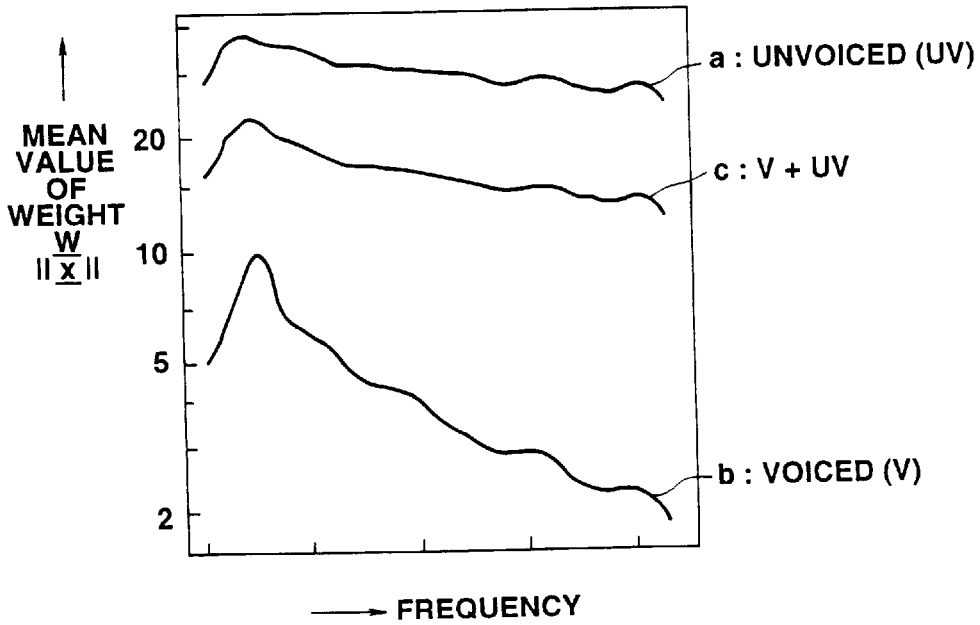
FIG. 7 is a graph showing mean values of a weight $W'/\|x\|$ for voiced sound, unvoiced sound and for the voiced and unvoiced sound collected together.

FIGS. 6 and 7 show the mean values W'/||x|| of the input x and the mean value of the weight for the voiced sound, for the unvoiced sound and for the combination of the voiced and unvoiced sounds, that is without regard to the distinction between the voiced and unvoiced sounds.

It is seen from FIG. 6 that the energy distribution of x itself on the frequency axis is not vitally different with V and UV although the mean value of the gain (||x||) is vitally different between U and UV. However, it is apparent from FIG. 7 that the shape of the weight differs between V and UV and the weight is such a weight which increases bit assignment for the low range for V than for UV. This accounts for feasibility of formulation of a codebook of higher performance by separate training for V and UV.

Figure 8:
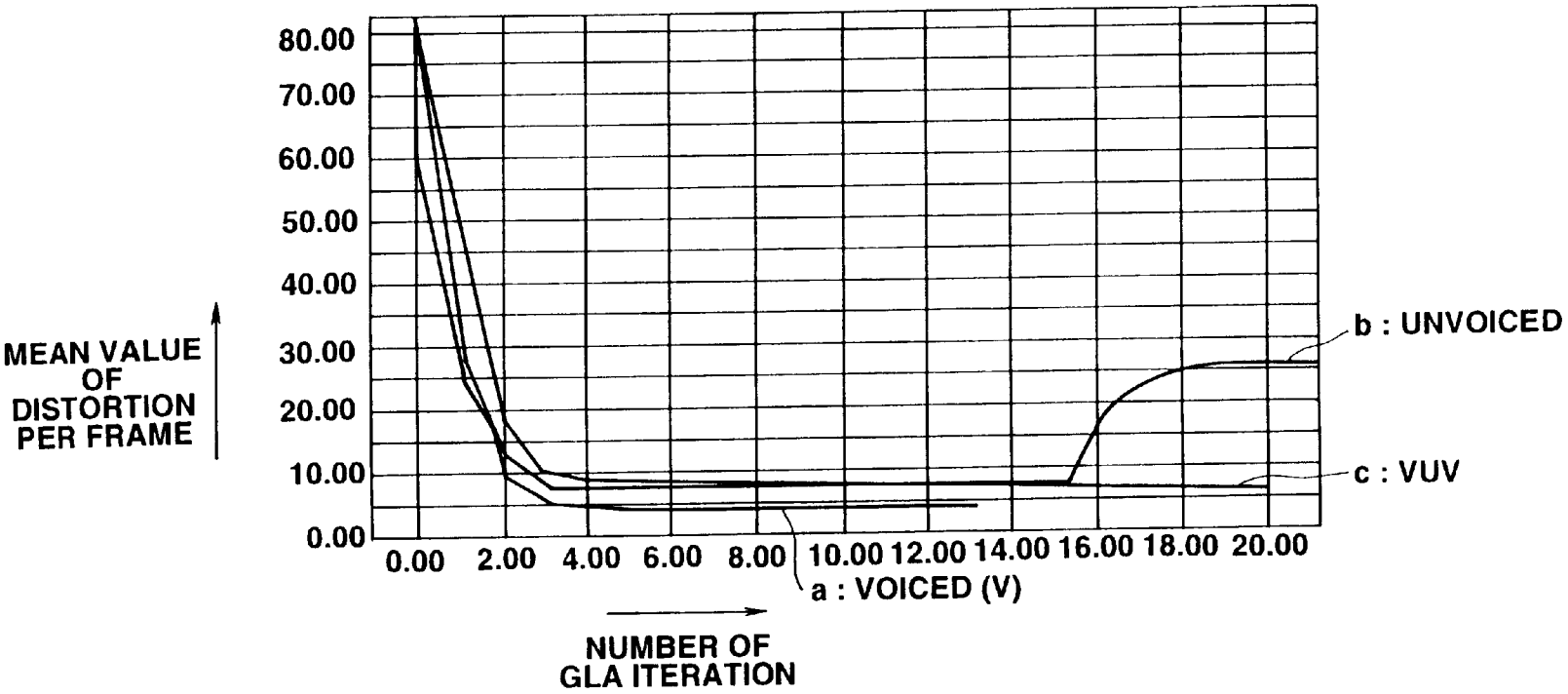
FIG. 8 is a graph showing the manner of training for the codebook for vector quantization for voiced sound, unvoiced sound and for the voiced and unvoiced sound collected together.

FIG. 8 shows the manner of training for three examples, that is for voiced sound (V), unvoiced sound (UV) and for the voiced and unvoiced sounds combined together. That is, curves a, b and c in FIG. 8 stand for the manner of training for V only, for UV only and for V and UV combined together, with the terminal values of the curves a, b and c being 3.72, 7.011 and 6.25, respectively.

It is seen from FIG. 8 that separation of training of the codebook for V and that for UV leads to a decreased expected value of output distortion. Although the state of the expected value is slightly worsened with the curve b for UV only, the expected value is improved on the whole since the domain for V is longer than that for UV. By way of an example of frequency of occurrence of V and UV, measured values of the domain lengths for V only and for UV only are 0.538 and 0.462 for the training data length of 1. Thus, from the terminal values of the curves a and b of FIG. 8, the expected value of the total distortion is given by $$3.72\times0.538+7.011\times0.462=5.24$$

which represents an improvement of approximately 0.76 dB as compared to the expected value of distortion of 6.25 for training for V and UV combined together.

Judging from the manner of training, the improvement in the expected value is on the order of 0.76 dB. However, it has been found that, if the speech samples of four male panelists and four female panelists outside the training set are processed for finding the SN ratio (SNR) for a case in which quantization is not performed, separation into V and UV leads to improvement in the segmental SNR on the order of 1.3 dB. The reason therefor is presumably that the ratio of V is significantly higher than that for UV.

It is noted that, while the weight W' employed for auditory sense weighting for vector quantization by the vector quantizer 23 is as defined by the above equation (6), the weight W' taking into account the temporal masking may be found by finding the current weight W' taking the past W' into account.

As for wh(1), wh(2), . . . , wh(L) in the above equation (6), those calculated at time n, that is for the n'th frame, are denoted as $wh_n$(1) , $wh_n$(2) , . . . , wh(L).

The weight taking into account the past value at time n is defined as $A_n(i)$, where $1 \leqq i \leqq L$. Then $$A_n(i) = \lambda A_{n-1}(i) + (1-\lambda) wh_n(i) \quad (wh_n(i) \le A_{n-1}(i))$$
$$= wh_n(i) \quad (wh_n(i) > A_{n-1}(i))$$

where λ may be set so that, for example, λ=0.2. $A_n(i)$, where $1 \leqq i \leqq L$, may be used as diagonal elements of a matrix, which is used as the above weight.

Returning to FIG. 1, the calculating unit for modified encoding parameters 3 is explained. The speech signal reproducing device 1 modifies the encoding parameters, outputted from the encoding unit 2, in speed, by the calculating unit for modified encoding parameters 3, for calculating the modified encoding parameters, and decodes the modified encoding parameters by the decoding unit 6 for reproducing the solid-recorded contents at a speed twice the real-time speed. Since the pitch and the phoneme remain unchanged despite a higher playback speed, the recorded contents can be heard even if the recorded contents are reproduced at an elevated speed.

Since the encoding parameters are modified in speed, the calculating unit for modified encoding parameters 3 is not in need of processing following decoding and outputting and is able to readily cope with different fixed rates with the similar algorithm.

Figure 9:
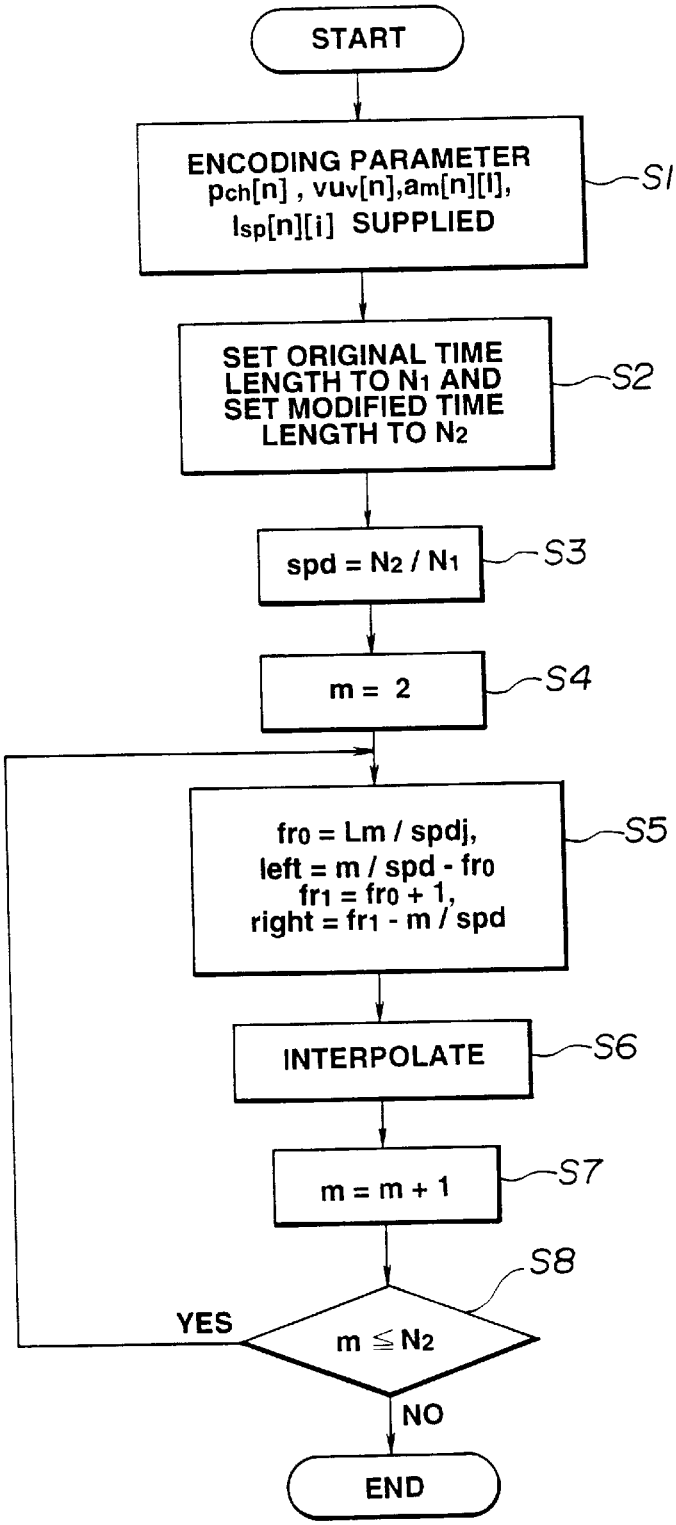
FIG. 9 is a flowchart showing the schematic operation of a modified encoding parameter calculating circuit employed in the speech signal reproducing device shown in FIG. 1.
Figure 11:
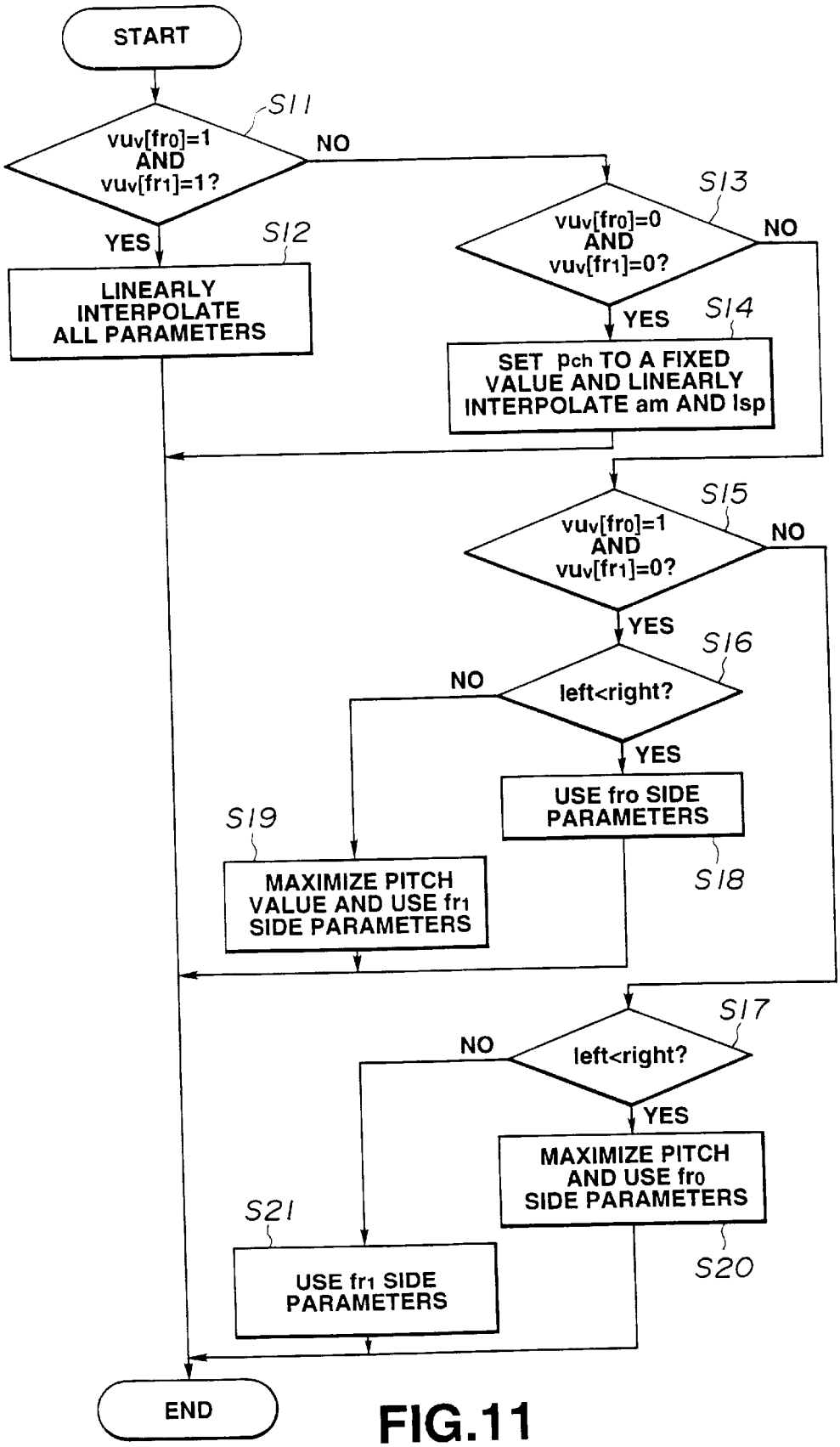
FIG. 11 is a flowchart showing a detailed operation of a modified encoding parameter calculating circuit used in the speech signal reproducing device shown in FIG. 1.

Referring to the flowcharts of FIGS. 9 and 11, the operation of the modified encoding parameter calculating unit 3 of the speech signal reproducing device 1 is explained in detail. The modified encoding parameter calculating unit 3 is made up of the period modification circuit 4 and the interpolation circuit 5, as explained with reference to FIG. 2.

First, at step S1 of FIG. 9, the period modification circuit 4 is fed via input terminals 15, 28, 29 and 26 with encoding parameters, such as LSP, pitch, V/UV or Am. The pitch is set to $P_{ch}$[n], V/UV is set to $vu_v$[n], Am is set to $a_m$[n][1] and LSP is set to $l_{sp}$[n][i]. The modified encoding parameters, ultimately calculated by the modified encoding parameter calculating unit 3, are set to mod_$p_{ch}$[m], mod_$vu_v$[m], mod_$a_m$[m][l] and mod $l_{sp}$[m][i], where l denotes the number of harmonics, i denotes the number of order of LSP, and n and m correspond to frame numbers corresponding in turn to the index of the time axis before and after time axis transformation, respectively. Meanwhile, $0 \leqq n \leqq N_1$ and $0 \leqq m \leqq N_2$, with n and m each being a frame index with the frame interval being e.g., 20 msec.

As described above, l denotes the number of harmonics. The above setting may be performed after restoring the number of harmonics to $a_m$[n][l] corresponding to the real number of harmonics, or may also be executed in the state of $a_m$[n][l] (l=0~43). That is, the data of number conversion may be carried out before or after decoding by the decoder.

At step S2, the period modification circuit 4 sets the number of frames corresponding to the original time length to $N_1$, while setting the number of frames corresponding to the post-change time length to $N_2$. Then, at step S3, the period modification circuit 4 time-axis compresses the speech of $N_1$ to the speed of $N_2$. That is, a ratio of time-axis compression spd by the period modification circuit 4 is found as $N_2/N_1$.

Then, at step S4, the interpolation circuit 5 sets m corresponding to the frame number corresponding in turn to the time-axis index after time-axis transformation to 2.

Figure 10:
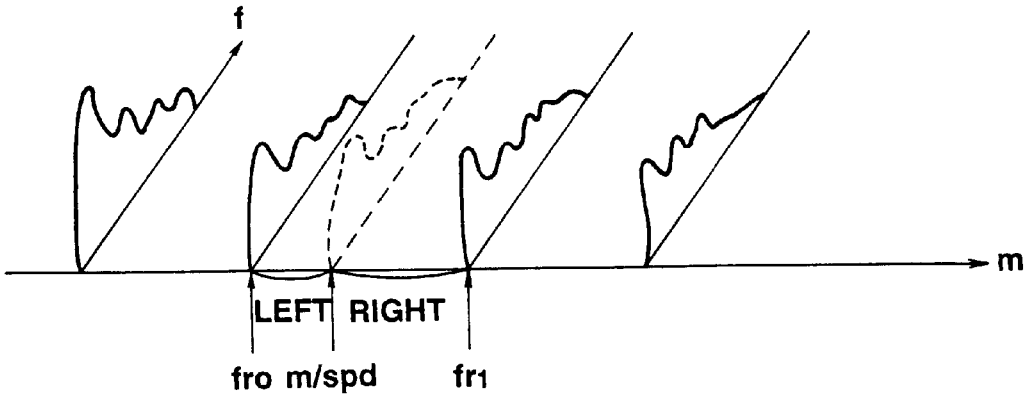
FIG. 10 is a schematic view showing the modified encoding parameters obtained by the modified parameter calculating circuit on the time axis.

Then, at step S5, the interpolation circuit 5 finds two frames $f_{r0}$ and $f_{r1}$ and the differences 'left' and 'right' between the two frames $f_{r0}$ and $f_{r1}$ and m/spd. If the encoding parameters $P_{ch}$, $vu_v$, $a_m$ and $l_{sp}$ are denoted as *, mod_*[m] may be expressed by the general formula $$\text{mod_}*[m]=*[m/spd]$$

where $0 \leqq m \leqq N_2$. However, since m/spd is not an integer, the modified encoding parameter for m/spd is produced by interpolation from the two frames of $f_{r0}$=Lm/spd and $f_{r1}$=$f_0$+1. It is noted that, between the frame $f_{r0}$, m/spd and the frame $f_{r1}$, the relation as shown in FIG. 10, that is the relation:

$$\text{left}=m/spd-f_{r0}$$

$$\text{right}=f_{r1}-m/spd$$

holds.

The encoding parameter for m/spd in FIG. 10, that is the modified encoding parameter, is produced by interpolation as shown at step S6. The modified encoding parameter may be simply found by linear interpolation as $$\text{mod_}*[m]=*[f_{r0}]\times\text{right}+*[f_{r1}]\times\text{left}$$

However, if, with the interpolation between the $f_{r0}$ and $f_{r1}$, these two frames differ as to V/UV, that is if one of the two frames is V and the other UV, the above general formula cannot be applied. Therefore, the interpolation circuit 5 modifies the manner of finding the encoding parameters in connection with the voiced and unvoiced characteristics of these two frames $f_{r0}$ and $f_{r1}$, as indicated in step S11 ff. of FIG. 11.

It is first judged as to whether or not the two frames $f_{r0}$ and $f_{r1}$ are voiced (V) or unvoiced (UV). If it is found that both the frames $f_{r0}$ and $f_{r1}$ are voiced (V), the program transfers to step S12 where all parameters are linearly interpolated and the modified encoding parameters are represented as:

$$\text{mod_}p_{ch}[m]=p_{ch}[f_{r0}]\times\text{right}+p_{ch}[f_{r1}]\times\text{left}$$

$$\text{mod_}a_m[m][l]=a_m[f_{r0}][l]\times\text{right}+a_m[f_{r1}][l]\times\text{left}$$

where $0 \leqq l < L$. It is noted that L denotes the maximum possible number that can be taken as harmonics, and that '0' is stuffed in $a_m$[n][l] where there is no harmonics. If the number of harmonics differs between the frames $f_{r0}$ and $f_{r1}$, the value of the counterpart harmonics is assumed to be zero in carrying out interpolation, If before passage through the number of data conversion unit, the number of L may be fixed, such as at L=43, with $0 \leqq l < L$.

In addition, the modified encoded parameters are also represented as:

$$\text{mod_}l_{sp}[m][i]=l_{sp}[f_{r0}][i]\times\text{right}+l_{sp}[f_{r1}][i]\times\text{left}$$

where $0 \leqq i < I$ and I denotes the number of orders of LSP and is usually 10; and $$\text{mod_}vu_v[m]=1$$

It is noted that, in V/UV discrimination, 1 and 0 denote voiced (V) and unvoiced (UV), respectively.

If it is judged at step S11 that none of the two frames $f_{r0}$ and $f_{r1}$ is voiced (V), a judgment similar to that given at step S13, that is the judgment as to whether or not both the frames $f_{r0}$ and $f_{r1}$ are unvoiced (UV), is given. If the result of judgment is YES, that is if both the two frames are unvoiced (UV), the interpolation circuit 5 sets $P_{ch}$ to a fixed value, and finds $a_m$ and $l_{sp}$ by linear interpolation as follows:

$$\text{mod_}p_{ch}[m]=\text{MaxPitch}$$

for fixing the value of pitch to a fixed value, such as a maximum value, for the unvoiced sound, by e.g., MaxPitch=148;

$$\text{mod_}a_m[m][l]=a_m[f_{r0}][l]\times\text{right}+a_m[f_{r1}][l]\times\text{left}$$

where $0 \leqq l < \text{MaxPitch}$;

$$\text{mod_}l_{sp}[m][1]=l_{sp}[f_{r0}][i]\times\text{right}+l_{sp}[f_{r1}][i]\times\text{left}$$

where $0 \leqq i < I$; and $$\text{mod_}vu_v[m]=0.$$

If both of the two frames $f_{r0}$ and $f_{r1}$ are not unvoiced, the program transfers to step S15 where it is judged whether the frame $f_{r0}$ is voiced (V) and the frame $f_{r1}$ is unvoiced (UV). If the result of judgment is YES, that is if the frame $f_{r0}$ is voiced (V) and the frame $f_{r1}$ is unvoiced (UV), the program transfers to step S16. If the result of judgment is NO, that is if the frame $f_{r0}$ is unvoiced (UV) and the frame $f_{r1}$ is voiced (V), the program transfers to step S17.

The processing of step S16 ff. refers to the cases wherein the two frames $f_{r0}$ and $f_{r1}$ differ as to V/UV, that is, wherein one of the frames is voiced and the other unvoiced. This takes into account the fact that parameter interpolation between the two frames $f_{r0}$ and $f_{r1}$ differing as to V/UV is of no significance. In such case, the parameter value of a frame closer to the time m/spd is employed without performing interpolation.

If the frame $f_{r0}$ is voiced (V) and the frame $f_{r1}$ unvoiced (UV), the program transfers to step S16 where the sizes of 'left' (=m/spd−$f_{r0}$) and 'right' (=$f_{r1}$−m/spd) shown in FIG. 10 are compared to each other. This enables a judgment to be given as to which of the frames $f_{r0}$ and $f_{r1}$ is closer to m/spd. The modified encoding parameters are calculated using the values of the parameters of the frame closer to m/spd.

If the result of judgment at step S16 is YES, it is 'right' that is larger and hence it is the frame $f_{r1}$ that is further from m/spd. Thus the modified encoding parameters are found at step S18 using the parameters of the frame $f_{r0}$ closer to m/spd as follows:

$$mod_p_{ch}[m]=p_{ch}[f_{r0}]$$

$$mod_a_m[m][l]=a_m[f_{r0}][l] \text{ (where } 0 \leqq l < L)$$

$$mod_l_{sp}[m][i]=l_{sp}[f_{r0}][i] \text{ (where } 0 \leqq i < L)$$

$$mod_vu_v[m]=1$$

If the result of judgment at step S16 is NO, left≧right, and hence the frame $f_{r1}$ is closer to m/spd, so the program transfers to step S19 where the pitch is maximized in value and, using the parameters for the frame $f_{r1}$, the modified encoding parameters are set so that $$mod_p_{ch}[m]=MaxPitch$$

$$mod_a_m[m][l]=a_m[f_{r1}][l] \text{ (where } 0 \leqq l < MaxPitch/2)$$

$$mod_l_{sp}[m][i]=l_{sp}[f_{r1}][i] \text{ (where } 0 \leqq i < L)$$

$$mod_vu_v[m]=0$$

Then, at step S17, responsive to the judgment at step S15 that the two frames $f_{r0}$ and $f_{r1}$ are unvoiced (UV) and voiced (V), respectively, a judgment is given in a manner similar to that of step S16. That is, in this case, interpolation is not performed and the parameter value of the frame closer to the time m/spd is used.

If the result of judgment at step S17 is YES, the pitch is maximized in value at step S20 and, using the parameters for the closer frame $f_{r0}$ for the remaining parameters, the modified encoding parameters are set so that $$mod_p_{ch}[m]=MaxPitch$$

$$mod_a_m[m][l]=a_m[f_{r0}][l] \text{ (where } 0 \leqq l < MaxPitch)$$

$$mod_l_{sp}[m][i]=l_{sp}[f_{r0}][i] \text{ (where } 0 \leqq i < l)$$

$$mod_vu_v[m]=0$$

If the result of judgment at step S17 is NO, since left≧right, and hence the frame $f_{r1}$ is closer to m/spd, the program transfers to step S21 where, with the aid of the parameters for the frame $f_{r1}$, the modified encoding parameters are set so that $$mod_p_{ch}[m]=p_{ch}[f_{r1}]$$

$$mod_a_m[m][l]=a_m[f_{r1}][l] \text{ (where } 0 \leqq l < L)$$

$$mod_l_{sp}[m][i]=l_{sp}[f_{r1}][i] \text{ (where } 0 \leqq l < L)$$

$$mod_vu_v[m]=1$$

In this manner, the interpolation circuit 5 performs different interpolating operations at step S6 of FIG. 9 depending upon the relation of the voiced (V) and unvoiced (UV) characteristics between the two frames $f_{r0}$ and $f_{r1}$. After termination of the interpolating operation at step S6, the program transfers to step S7 where m is incremented. The operating steps of the steps S5 and S6 are repeated until the value of m becomes equal to $N_2$.

In addition, the sequence of the short-term rms for the UV portions is usually employed for noise gain control. However, this parameter is herein set to 1.

The operation of the modified encoding parameter calculating unit 3 is schematically shown in FIG. 12. The model of the encoding parameters extracted every 20 msecs by the encoding unit 2 is shown at A in FIG. 12. The period modification circuit 4 of the modified encoding parameter calculating unit 3 sets the period to 15 msecs and effect compression along time axis, as shown at b in FIG. 12. The modified encoding parameters shown at C in FIG. 12 are calculated by the interpolating operation conforming to the V/UV states of the two frames $f_{r0}$ and $f_{r1}$, as previously explained.

It is also possible for the modified encoding parameter calculating unit 3 to reverse the sequence in which the operations by the period modification circuit 4 and the interpolation circuit 5 are performed, that is to carry out interpolation of the encoding parameters shown at A in FIG. 13 as shown at B in FIG. 13 and to carry out compression for calculating the modified encoding parameters as shown at C in FIG. 13.

The modified encoding parameters from the modified encoding parameter calculating circuit 3 are fed to the decoding circuit 6 shown in FIG. 1. The decoding circuit 6 synthesizes the sine waves and the noise based upon the modified encoding parameters and outputs the synthesized sound at the output terminal 37.

Figure 14:
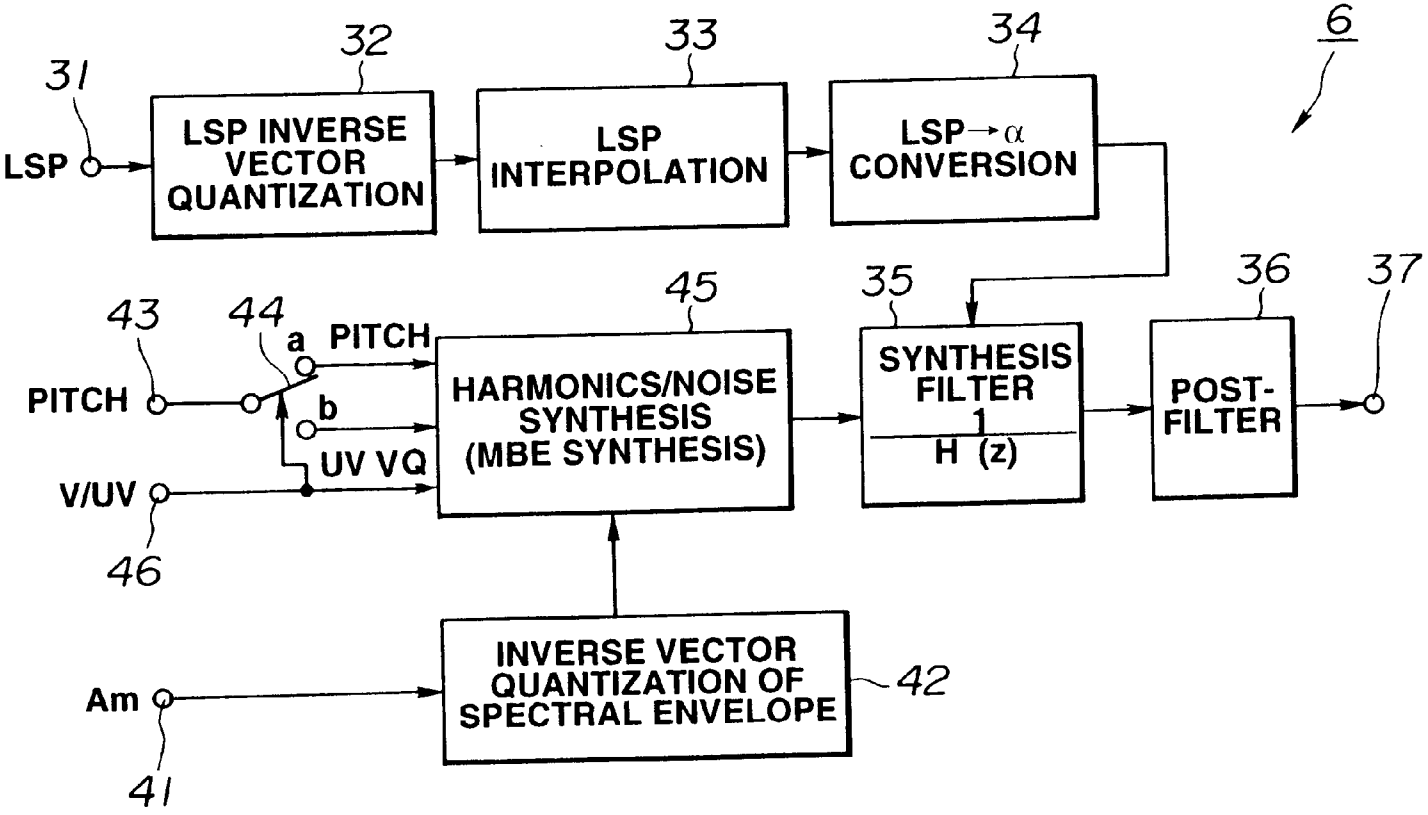
FIG. 14 is a schematic block circuit diagram showing a decoder used in the speech signal reproducing device.
Figure 15:
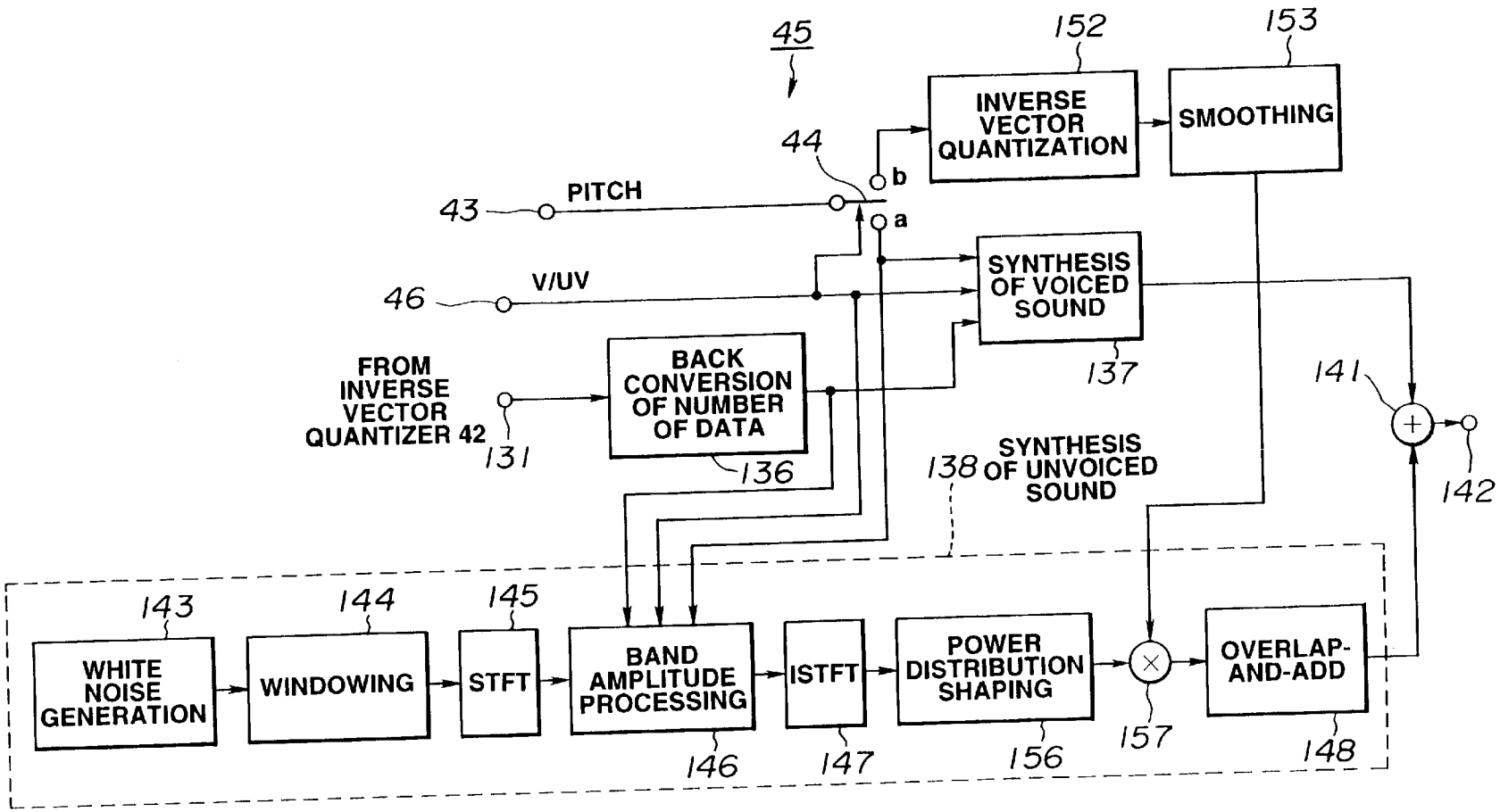
FIG. 15 is a block circuit diagram showing an arrangement of a multi-band excitation (MBE) synthesis circuit as an illustrative example of a harmonics/noise synthesis circuit used in the decoder.

The decoding unit 6 is explained by referring to FIGS. 14 and 15. It is assumed for explanation sake that the parameters supplied to the decoding unit 6 are usual encoding parameters.

Referring to FIG. 14, a vector-quantized output of the LSP, corresponding to the output of the terminal 15 of FIG. 3, that is the so-called index, is supplied to a terminal 31.

This input signal is supplied to an inverse LSP vector quantizer 32 for inverse vector quantization to produce line spectral pair (LBP) data which is then supplied to an LSP interpolation circuit 33 for LSP interpolation. The resulting interpolated data is converted by an LSP to a conversion circuit 32 into α-parameters of the linear prediction codes (LPC). These α-parameters are fed to a synthesis filter 35.

To a terminal 41 of FIG. 14, there is supplied index data for weighted vector quantized code word of the spectral envelope (Am) corresponding to the output at a terminal 26 of the encoder shown in FIG. 3. To a terminal 43, there are supplied the pitch information from the terminal 28 of FIG. 3 and data indicating the characteristic quantity of the time waveform within a UV block, whereas, to a terminal 46, there is supplied the V/UV discrimination data from a terminal 29 of FIG. 3.

The vector-quantized data of the amplitude Am from the terminal 41 is fed to an inverse vector dequantizer 42 for inverse vector quantization. The resulting spectral envelope data are sent to a harmonics/noise synthesis circuit or a multi-band excitation (MBE) synthesis circuit 45. The synthesis circuit 45 is fed with data from a terminal 43, which is switched by a changeover switch 44 between the pitch data and data indicating a characteristic value of the waveform for the UV frame in dependence upon the V/UV discrimination data. The synthesis circuit 45 is also fed with V/UV discrimination data from the terminal 46.

The arrangement of the MBE synthesis circuit, as an illustrative arrangement of the synthesis circuit 45, will be subsequently explained by referring to FIG. 15.

From the synthesis circuit 45 are taken out LPC residual data corresponding to an output of the inverse filtering circuit 21 of FIG. 3. The residual data thus taken out is sent to the synthesis circuit 35 where LPC synthesis is carried out to produce time waveform data which is filtered by a post-filter 36 so that reproduced time-domain waveform signals are taken out at the output terminal 37.

An illustrative example of an MBE synthesis circuit, as an example of the synthesis circuit 45, is explained by referring to FIG. 15.

Referring to FIG. 15, spectral envelope data from the inverse vector quantizer 42 of FIG. 14, in effect the spectral envelope data of the LPC residuals, are supplied to the input terminal 131. Data fed to the terminals 43, 46 are the same as those shown in FIG. 14. The data supplied to the terminal 43 are selected by the changeover switch 44 so that pitch data and data indicating characteristic quantity of the UV waveform are fed to a voiced sound synthesizing unit 137 and to an inverse vector quantizer 152, respectively.

The spectral amplitude data of the LPC residuals from the terminal 131 are fed to a number of data back-conversion circuit 136 for back inversion. The number of data back-inversion circuit 136 performs back conversion which is the reverse of the conversion performed by the number of data conversion unit 119. The resulting amplitude data is fed to the voiced sound synthesis unit 137 and to an unvoiced sound synthesis unit 138. The pitch data obtained from the terminal 43 via a fixed terminal a of the changeover switch 44 is fed to the synthesis units 137, 138. The V/UV discrimination data from the terminal 46 are also fed to the synthesis units 137, 138.

The voiced sound synthesis unit 137 synthesizes the time-domain voiced sound waveform by e.g., cosine or sine wave synthesis, while the unvoiced sound synthesis unit 138 filters e.g., the white noise by a band-pass filter to synthesize a time-domain non-voiced waveform. The voiced waveform and the non-voiced waveform are summed together by an adder 141 so as to be taken out at an output terminal 142.

If the V/UV code is transmitted as the V/UV discrimination data, the entire bands can be divided at a sole demarcation point into a voiced (V) region and an unvoiced (UV) region and band-based V/UV discrimination data may be obtained based on this demarcation point. If the bands are degraded on the analysis (encoder) side to a constant number of, e.g., 12 bands, this degradation may be canceled for providing a varying number of bands with a bandwidth corresponding to the original pitch.

The operation of synthesizing the unvoiced sound by the unvoiced sound synthesis unit 138 is explained.

The time-domain white-noise signal waveform from a white noise generator 143 is sent to a windowing unit 144 for windowing by a suitable windowing function, such as a Hamming window, with a pre-set length of e.g., 256 samples. The windowed signal waveform is then sent to a short-term Fourier transform (STFT) circuit 145 for STFT for producing the frequency-domain power spectrum of the white noise. The power spectrum from the STFT unit 145 is sent to a band amplitude processing unit 146 where the bands deemed to be UV are multiplied with the amplitude $|A_m|_{UV}$ while the bandwidth of other bands deemed to be V are set to 0. The band amplitude processing unit 146 is supplied with the amplitude data, pitch data and the V/UV discrimination data.

An output of the band amplitude processing unit 146 is sent to a ISTFT unit 147 where it is inverse STFTed, using the phase of the original white noise as the phase, for conversion into time-domain signals. An output of the ISTFT unit 147 is sent via a power distribution shaping unit 156 and a multiplier 157 as later explained to an overlap-and-add unit 148 where overlap-and-add is iterated with suitable weighting on the time axis for enabling restoration of the original continuous waveform. In this manner, the continuous time-domain waveform is produced by synthesis. An output signal of the overlap-and-add unit 148 is sent to the adder 141.

If at least one of the bands in the block is voiced (V), the above-mentioned processing is carried out in the respective synthesis units 137, 138. If the entire bands in the block are found to be UV, the changeover switch 44 has its movable contact 44 set to a fixed terminal b so that the information on the time waveform of the unvoiced signal is sent in place of the pitch information to the inverse vector quantization unit 152.

That is, the vector dequantization unit 152 is fed with data corresponding to data from the vector quantization unit 127 of FIG. 4. This data is inverse vector quantized for deriving data for extracting the characteristic quantity of the unvoiced signal waveform.

An output of the ISTFT unit 147 has the time-domain energy distribution trimmed by a power distribution shaping unit 156 before being sent to a multiplier 157. The multiplier 157 multiplies the output of the ISTFT unit 147 with a signal derived from the vector dequantization unit 152 via a smoothing unit 153. The rapid gain changes which feel harsh may be suppressed by the smoothing unit 153.

The unvoiced sound signal thus synthesized is taken out at the unvoiced sound synthesis unit 138 and sent to the adder 141 where it is added to the signal from the voiced sound synthesis unit 137 so that the LDC residual signals as the MBE synthesized output is taken out at the output terminal 142.

These LPC residual signals are sent to the synthesis filter 35 of FIG. 14 for producing an ultimate playback speech sound.

The speech signal reproducing device 1 causes the modified encoding parameter calculating unit 3 to calculate modified encoding parameters under control by a controller, not shown, and synthesizes the speech sound, which is the time-axis companded original speech signals, with the aid of the modified encoding parameters.

In this case, $mod_1_{sp}[m][i]$ from the modified encoding parameter calculating unit 3 is employed in place of an output of the LSP inverse vector quantization circuit 32. The modified encoding parameter $mod_1_{sp}[m][i]$ is employed in place of the value of the inherent vector dequantization. The modified encoding parameter $mod_1_{sp}[m][i]$ is sent to the LSP interpolation circuit 33 for LSP interpolation and thence supplied to the LSP to-α-converting circuit 34 where it is converted into the α-parameter of the linear prediction codes (LPC) which is sent to the synthesis filter 35.

On the other hand, the modified encoding parameter mod $a_m[m][1]$ is supplied in place of the output or the input of the number of data conversion circuit 136. The terminals 43, 46 are fed with $mod_p_{ch}[m]$ and with $mod_vu_v[m]$, respectively.

The modified encoding parameter $mod_a_m[m][1]$ is sent to the harmonics/noise synthesis circuit 45 as spectral envelope data. The synthesis circuit 45 is fed with $mod_p_{ch}[m]$ from the terminal 43 via the changeover switch 44 depending upon the discrimination data, while being also fed with $mod_vu_v[m]$ from the terminal 46.

By the above-described arrangement, shown in FIG. 15, the time axis companded original speech signals are synthesized, using the above modified encoding parameters, so as to be outputted at the output terminal 37.

Thus the speech signal reproducing device 1 decodes an array of the modified encoding parameter mod_*[m] ($0 \leqq m < N_2$) in place of the inherent array *[n] ($0 \leqq n < N_1$). The frame interval during decoding may be fixed as e.g., at 20 msec as conventionally. Thus, if $N_2 < N_1$ or $N_2 > N_1$, time axis compression with speed increase or time axis expansion with speed reduction is done, respectively.

If the time axis modification is carried out as described above, the instantaneous spectrum and the pitch remain unchanged, so that deterioration is scarcely produced despite significant modification in a range of from $0.5 \leqq spd \leqq 2$.

With this system, since the ultimately obtained parameter string is decoded after being arrayed with an inherent spacing of 20 msec, arbitrary speed control in the increasing or decreasing direction may be realized easily. On the other hand, speed increase and decrease may be carried out by the same processing without transition points.

Thus the solid-recorded contents may be reproduced at a speed twice the real-time speed. Since the pitch and the phoneme remain unchanged despite increased playback speed, the solid-recorded contents may be heard if reproduction is performed at a higher speed. On the other hand, as for the speech cordec, an ancillary operation) such as arithmetic operations after decoding and outputting, as required with the use of the CELP encoding, may be eliminated.

Although the modified encoding parameter calculating unit 3 is isolated with the above first embodiment from the decoding unit 6, the calculating unit 3 may also be provided in the decoding unit 6.

In calculating the parameters by the modified encoding parameter calculating unit 3 in the speech signal reproducing device 1, the interpolating operations on $a_m$ are executed on a vector-quantized value or on a inverse-vector-quantized value.

Figure 16:
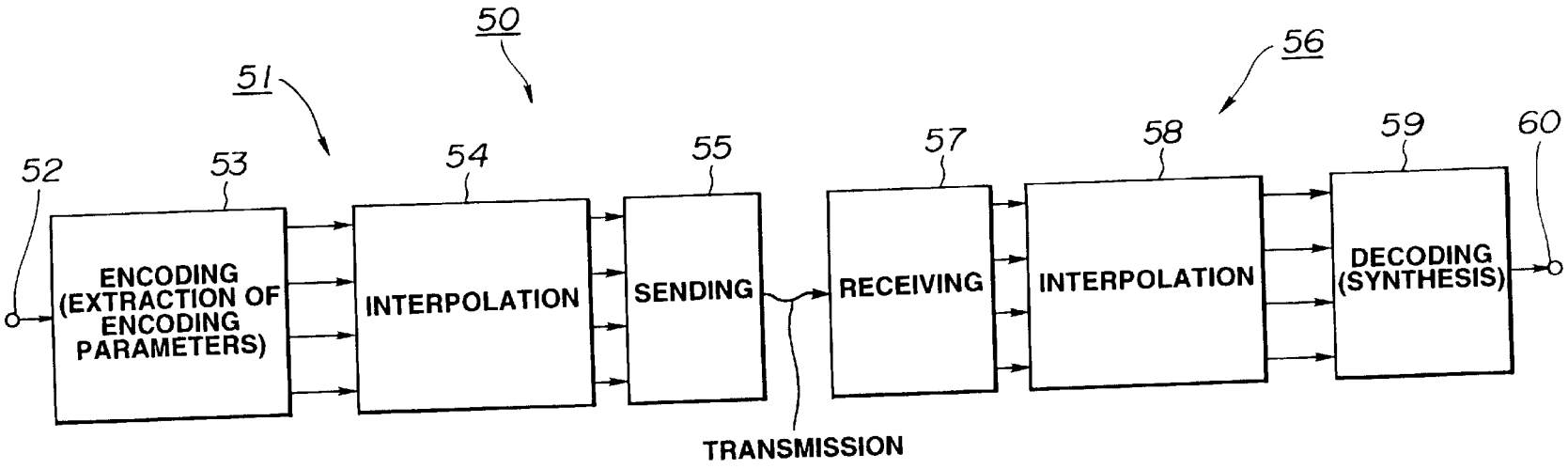
FIG. 16 is a schematic block diagram showing a speech signal transmission device as a second embodiment of the present invention.

A speech signal transmitting device 50 for carrying out the speech signal transmitting method according to the present invention is explained. Referring to FIG. 16, the speech signal transmitting device 50 includes a transmitter 51 for splitting an input speech signal in terms of pre-set time-domain frames as units and encoding the input speech signal on the frame basis for finding encoding parameters, interpolating the encoding parameters to find modified encoding parameters and for transmitting the modified encoding parameters. The speech signal transmitting device 50 also includes a receiver 56 for receiving the modified encoding parameters and for synthesizing the sine wave and the noise.

That is, the transmitter 51 includes an encoder 53 for splitting the input speech signal in terms of pre-set time-domain frames as units and encoding the input speech signal on the frame basis for extracting encoding parameters, an interpolator 54 for interpolating the encoding parameters for finding the modified encoding parameters, and a transmitting unit 55 for transmitting the modified encoding parameters. The receiver 56 includes a receiving unit 57, an interpolator 58 for interpolator 58 for interpolating the modified encoding parameters, and a decoding unit 59 for synthesizing the sine wave and the noise based upon the interpolated parameters for outputting the synthesized speech signals at an output terminal 60.

The basic operation of the encoding unit 53 and the decoding unit 59 is the same as that of the speech signal reproducing device 1 and hence the detailed description thereof is omitted for simplicity.

Figure 17:
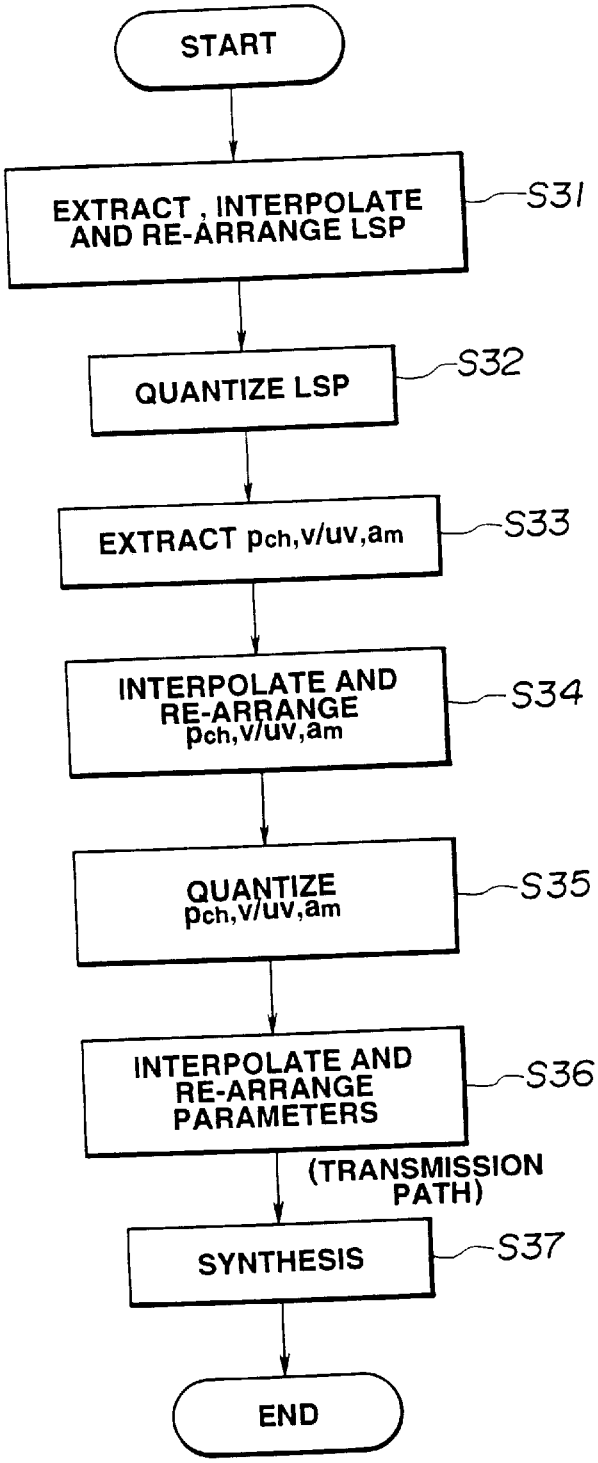
FIG. 17 is a flowchart showing the operation of a transmission side of the speech signal transmission device.

The operation of the transmitter 51 is explained by referring to the flowchart of FIG. 17 in which the encoding operation by the encoding unit 53 and the interpolation by the interpolator 54 are collectively shown.

The encoding unit 53 extracts the encoding parameters made up of LSP, pitch Pch, V/UV and am at steps S31 and S33. In particular, LSP is interpolated and rearranged by the interpolator 54 at step S31 and quantized at step S32, while the pitch Pch, V/UV and am are interpolated and rearranged at step S34 and quantized at step S35. These quantized data are transmitted via the transmitter 55 to the receiver 56.

The quantized data received via the receiving unit 57 at the receiver 56 is fed to the interpolating unit 58 where the parameters are interpolated and rearranged at step S36. The data are synthesized at step S37 by the decoding unit 59.

Thus, for increasing the speed by time-axis compression, the speech signal transmitting device 50 interpolates parameters and modifies the parameter frame interval at the time of transmission. Meanwhile, since the reproduction is performed during reception by finding the parameters at the fixed frame interval, such as 20 msecs, the speed control algorithm may be directly employed for bit rate conversion.

That is, it is assumed that, if the parameter interpolation is employed for speed control, the parameter interpolation is carried out within the decoder. However, if this processing is carried out within the encoder such that time-axis compressed (decimated) data is encoded and time-axis expanded (interpolated) by the decoder, the transmission bit rate may be adjusted at the spd ratio.

If the transmission rate is e.g., 1.975 kbps and encoding is performed at the double speed by setting so that spd=0.5, since encoding is carried out at a speed of 5 seconds instead of at the inherent speed of 10 seconds, the transmission rate becomes 1.975×0.5 kbps.

Figure 18A:
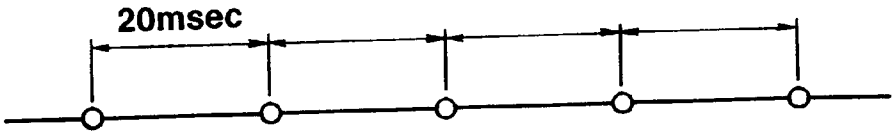
FIGS. 18A, 18B and 18C illustrate the operation of the speech signal transmission device.
Figure 18B:
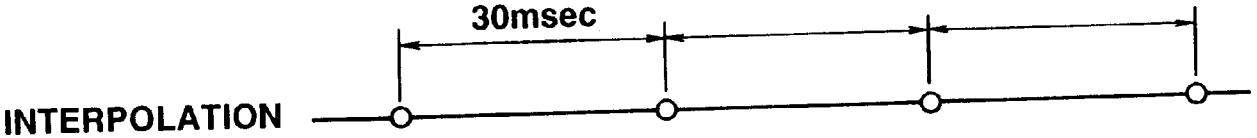
Figure 18C:
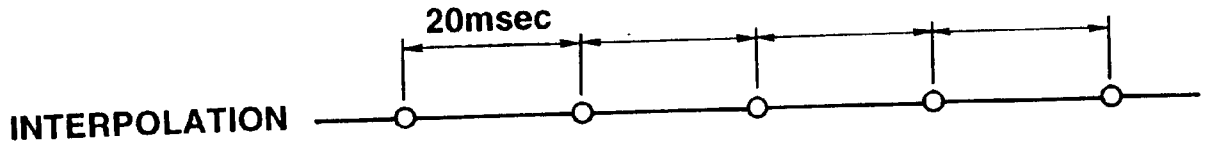

Also, the encoding parameters obtained at the encoding unit 53, shown at A in FIG. 18, is interpolated and re-arranged by the interpolator 54 at an arbitrary interval of e.g., 30 msecs, as shown at B in FIG. 18. The encoding parameters are interpolated and re-arranged at the interpolator 58 of the receiver 56 to 20 msec as shown at C in FIG. 18 and synthesized by the decoding unit 59.

If a similar scheme is provided within the decoder, it is possible to restore the speed to an original value, while it is also possible to hear the speech sound at the high or low speed. That is, the speed control can be used as variable bit rate cordec.

What is claimed is:

1. A method for reproducing an input speech signal based on first encoded parameters produced by dividing the input speech signal into frames having a predetermined length on a time axis and by encoding the input speech signal on a frame by frame basis, said first encoded parameters being spaced by a first interval, comprising the steps of:

producing second encoded parameters by interpolating said first encoded parameters, said second encoded parameters being spaced by a second interval different from said first interval; and generating a modified speech signal different in time scale from the input speech signal by using said second encoded parameters.

2. The method for reproducing an input speech signal as claimed in claim 1 wherein the modified speech signal is produced by at least synthesizing sine waves in accordance with the second encoded parameters.

3. The method for reproducing an input speech signal as claimed in claim 2 wherein a parameter period is changed by one of compressing and expanding the first encoded parameters respectively before or after the step of interpolating said first encoded parameters.

4. The method for reproducing an input speech signal as claimed in claim 1 wherein the step of interpolating said first encoded parameters is performed by linear interpolation of linear spectral pair parameters, pitch, and a residual spectral envelope contained in said first encoded parameters.

5. The method for reproducing an input speech signal as claimed in claim 1 wherein said first encoded parameters used are determined by representing short-term prediction residuals of the input speech signal as a synthesized sine wave and noise and by encoding frequency spectral information of each of the synthesized sine wave and the noise.

6. An apparatus for reproducing a speech signal in which an input speech signal is regenerated based on first encoded parameters determined by dividing the input speech signal into frames having predetermined length on a time axis and by encoding the input speech signal on a frame by frame basis, said first encoded parameters being spaced by a first interval, comprising:

interpolation means for producing second encoded parameters by interpolating said first encoded parameters, said second encoded parameters being spaced by a second interval different from said first interval; and speech signal generating means for generating a modified speech signal different in time scale from the input speech signal by using said second encoded parameters.

7. The speech signal generating apparatus as claimed in claim 6 wherein said speech signal generating means generates said modified speech single by at least synthesizing a sine wave in accordance with said second encoded parameters.

8. The speech signal generating apparatus as claimed in claim 7 further comprising period changing means at one of upstream and downstream of said interpolating means for respectively compressing and expanding said first encoded parameters to change encoded parameter periods.

9. The speech signal generating apparatus as claimed in claim 6 wherein said interpolating means perform linear interpolation on linear spectral pair parameters, pitch, and residual spectral envelope contained in said first encoded parameters.

10. The speech signal generating apparatus as claimed in claim 6 wherein said first encoded parameters used are determined by representing short-term prediction residuals of the input speech signal as a synthesized sine wave and noise and by encoding frequency spectral information of each of the synthesized sine wave and the noise.

11. A method for transmitting a speech signal comprising the steps of:

producing first encoded parameters by dividing an input speech signal into frames having predetermined length on a time axis and by encoding the input speech signal on a frame by frame basis, said first encoded parameters being spaced by a first interval;

producing second encoded parameters by interpolating said first encoded parameters, said second encoded parameters being spaced by a second interval different from said first interval; and transmitting said second encoded parameters.

12. The method for transmitting the input speech signal as claimed in claim 11 wherein said first encoded parameters used are determined by representing short-term prediction residuals of the input speech signal as a synthesized sine wave and noise and by encoding frequency spectral information of each of the synthesized sine wave and the noise.

* * * * *